United States Patent [19]

Kusaba et al.

[11] Patent Number: 4,841,611

[45] Date of Patent: Jun. 27, 1989

[54] WORK ROLL WITH DULLED SURFACE HAVING GEOMETRICALLY PATTERNED UNEVEN DULLED SECTIONS FOR TEMPER ROLLING

[75] Inventors: Takashi Kusaba; Hideo Abe; Akira Torao, all of Chiba; Kusuo Furukawa, Tokyo; Takayuki Yanagimoto; Hiroaki Sasaki, both of Chiba, all of Japan

[73] Assignee: Kawasaki Steel Corporation, Tokyo, Japan

[21] Appl. No.: 72,429

[22] Filed: Jul. 13, 1987

[30] Foreign Application Priority Data

| | | | |
|---|---|---|---|
| Jul. 14, 1986 | [JP] | Japan | 61-165147 |
| Jul. 14, 1986 | [JP] | Japan | 61-165148 |
| Nov. 13, 1986 | [JP] | Japan | 61-268530 |
| Nov. 19, 1986 | [JP] | Japan | 610273946 |
| Jan. 9, 1987 | [JP] | Japan | 62-3081 |
| Jun. 5, 1987 | [JP] | Japan | 62-140098 |
| Jun. 8, 1987 | [JP] | Japan | 62-141617 |

[51] Int. Cl.[4] ..... B21B 1/00

[52] U.S. Cl. ..... 29/121.2; 29/121.1; 29/130; 29/132

[58] Field of Search ..... 29/121.1, 121.8, 130, 29/132, 121.2, 121.4, 121.5, 121.6, 121.7; 219/121 LM; 428/681-685

[56] References Cited

U.S. PATENT DOCUMENTS

| | | | |
|---|---|---|---|
| 3,177,558 | 4/1965 | Gronholz et al. | 29/121.8 |
| 3,619,881 | 11/1971 | Bills et al. | 29/121 R |
| 3,754,873 | 8/1973 | Bills et al. | 29/183.5 |
| 4,015,100 | 3/1977 | Granamuthu et al. | 29/132 |
| 4,026,007 | 5/1977 | Brower | 29/121.8 |
| 4,200,389 | 4/1980 | Matsiu et al. | 29/121.8 |
| 4,329,562 | 5/1982 | Crahay et al. | 219/121 |
| 4,433,032 | 2/1984 | Nakamura et al. | 29/132 |
| 4,548,653 | 10/1985 | Bocquet et al. | 29/132 |
| 4,609,577 | 9/1986 | Long | 29/132 |
| 4,628,179 | 12/1986 | Crahay | 219/121 LH |
| 4,697,320 | 10/1987 | Ishihara et al. | 29/132 |
| 4,727,740 | 3/1988 | Yabuki et al. | 29/132 |

FOREIGN PATENT DOCUMENTS

| | | | |
|---|---|---|---|
| 0119182 | 9/1984 | European Pat. Off. . | |
| 0157754 | 10/1985 | European Pat. Off. | 29/121.8 |
| 0168374 | 1/1986 | European Pat. Off. . | |
| 0184568 | 6/1986 | European Pat. Off. . | |
| 2001915 | 1/1970 | Fed. Rep. of Germany . | |
| 2840702 | 4/1979 | Fed. Rep. of Germany . | |
| 56-160892 | 10/1981 | Japan . | |

*Primary Examiner*—P. W. Echols
*Assistant Examiner*—Irene Cuda
*Attorney, Agent, or Firm*—Austin R. Miller

[57] ABSTRACT

A work roll has a regularly and geometrically patterned uneven dulled section on the roll surface. Each uneven dulled section is composed of a crest and concavity and is of crater-like configuration. In order to obtain good performance in temper rolling, the crest is in a form of an annular ring extending around the edge of the concavity. According to the invention, pattern of arrangement of the uneven dulled sections is determined in relation to the diameter of the ring-shaped crests of the uneven dulled section so as to obtain optimum performance in producing good quality, exhibiting substantially high image clarify as coated by paint, enamel or so forth.

16 Claims, 36 Drawing Sheets

HARDNESS (Hv)
1,000
900
800
700
600
500
400
300
20
0
−20
−40
−60
−80
SUBZERO TEMP. (°C)

ROLL ROUGHNESS DROP
ROLL SURFACE HARDNESS
OPTIMUM RANGE
HARDNESS (Hv)
1,000
800
600
400
200
0
ROUGHNESS DROP % (ΔRz/Rz)
50
40
30
20
10
0
10
20
30
40
50
AUSTENITE CONTENT (%)
−150°C
−100°C
−50°C
0°C
SUBZERO TEMP.

PRESSURE (kg/mm²)
1,400
1,200
1,000
800
600
400
200
0
2
4
6
8
10
12
14
16
CONTACT AREA RATIO (%)
63 kg/mm²
45 kg/mm²
32 kg/mm²

ROLL SURFACE ROUGHNESS DROP RATIO (%)
−40
−30
−20
−10
0
200
400
600
800
1,000
1,200
PRESSURE (kg/mm²)

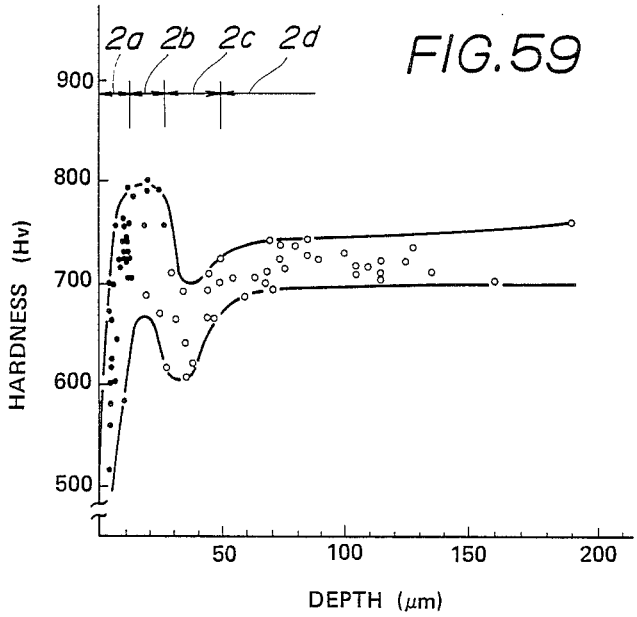
FIG.59
FIG.60
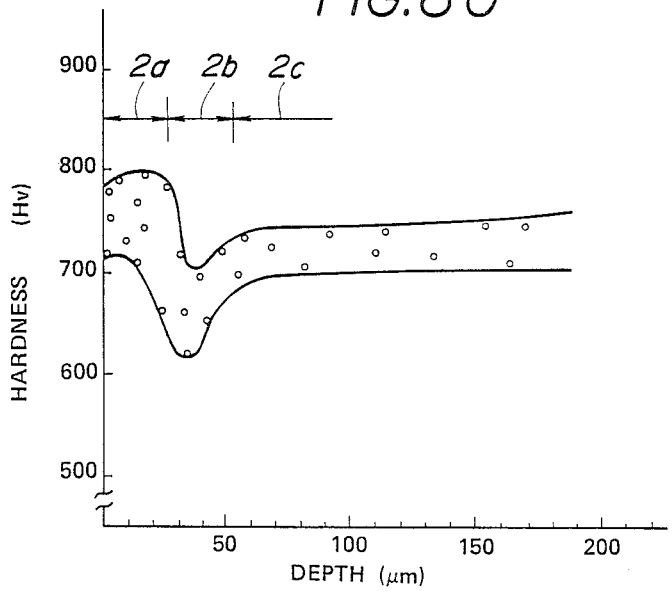

210
258
245
246
256
242a
254a
244
242b
226
230
224a
225
232
228
222
224
234
220
214
254
256
260
262
242
240
248
250
252
251
280
282

214
210
226
224
220
222
212
234
224
228

WORK ROLL WITH DULLED SURFACE HAVING GEOMETRICALLY PATTERNED UNEVEN DULLED SECTIONS FOR TEMPER ROLLING

BACKGROUND OF THE INVENTION

1. Field of the Invention

The present invention relates generally to a work roll for a rolling mill, such as cold rolling mill. More specifically, the invention relates to a work roll which has a geometrically patterned uneven dulled section with controlled roughness, to be used as a temper roll in a rolling process for producing a metal strip, sheet or plate with an improved property for coating with a coat, such as paint, enamel and so forth. Further particularly, the invention relates to a work roll suitable for production of metal strip, sheet or plate suitable to be used as painted outer panels for automotive vehicle, decorative colored panel for electric appliance and so forth.

2. Description of the Background Art

As a typical example of the painted metal sheet, the cold rolled thin steel sheet is usually produced by subjecting the cold rolled steel sheet to degreasing, annealing and temper rolling in order. In this case, the temper rolling is to improve the galling resistance in the press forming by conducting a light rolling through work rolls having a dulled surface to give a proper surface roughness to the steel sheet surface.

When such a metal plate, panel or sheet is used for a vehicular panel, particularly for a vehicular outer panel, the finish feeling after painting is a very important factor for evaluation of the vehicle per se since the external appearance of the vehicular body can be directly appealing to the customer. There are various factors for determining the quality off the painted metal sheet, panel or plate. Among the various factors, it is considered as particularly important to have a glossiness lessening any irregular reflection on the painted surface and an image clarity defining few image strains. In general the combination of the glossiness and the image clarity is referred to as "distinctness of image".

It is known that the distinctness of image on the painted surface is determined depending upon the kind of paint and the painting process but is strongly influenced by the roughness of the surface of the material metal sheet, panel or plate. Hereafter, the word "metal sheet" is used for representing various forms of metal products, including metal strip, metal panel, metal plate and so forth. Namely, when the ratio of the flat section occupied in the steel sheet surface is small and the uneveness is great, the ratio of the flat section occupied in the painted surface becomes smaller and the uneveness becomes larger, and consequently an irregular reflection of light is caused to degrade the glossiness and the image clarity, which lowers image distinctness.

In general, the roughness of the metal sheet surface is generally represented by a center-line average roughness Ra. Further, it is well known that as the center-line average roughness Ra becomes larger, the magnitude of height difference between crest and portions of the roughness becomes greater and hence the uneveness of the painted surface becomes greater, which degrades image distinctness.

When the metal sheet is subject to a temper rolling process with a working roll dulled through the conventional shot blasting process or the discharge working process, it exhibits a rough surface composed of irregularly patterned uneven dulled portions, i.e. irregularly arranged crests and concavities, as set forth above, wherein the flat section is a very small proportion of the surface area. When paint is applied to such a metal sheet, the ratio of the flat portion occupied in the painted area becomes small since the coating is formed along the surface configuration.

In order to improve the problems in the prior art set forth above, there has been proposed a surface treatment process for the work roll by means of a laser beam. Such laser beam surface treatment processes for work rolls have been disclosed in the Japanese Patent First (unexamined) Publication (Tokkai) No. Shows 56-160892, the Japanese Patent Second (examined) Publication (Tokko) No. Showa 58-22587, the Japanese Patent First Publication (Tokkai) No. Showa 54-61043, and the Japanese Patent First Publication (Tokkai) No. Showa 55-94790, for example. However, such prior proposed processes are not always successful to provide a satisfactory property for the work roll surface. In one problem encountered in the prior proposed processes, the treated surface property of the work roll tends to fluctuate depending on the condition of the work roll per se. This means, in a certain work roll condition, the property of the work roll surface obtained by laser beam surface treatment tends to be inapplicable for temper rolling of this type.

SUMMARY OF THE INVENTION

Therefore, it is an object of the present invention to provide a work roll for temper rolling which has an improved performance in production of metal sheets which can provided with satisfactorily high image clarity as coated by paint, enamel or so forth.

In order to accomplish the aforementioned and other objects, a work roll, according to the present invention, has a regularly and geometrically patterned, uneven, dulled section on the roll surface. Each uneven dulled section is composed of a crest and concavity and is of crater-like configuration. In order to obtain good performance in temper rolling, the crest is in a form of an annular ring extending around the edge of the concavity. According to the invention, the pattern of arrangement of the uneven dulled sections is determined in relation to the diameter of the ring-shaped crests of the uneven dulled section so as to obtain optimum performance in producing good quality exhibiting products substantially high image clarity as coated by paint, enamel or so forth.

Particularly, the work roll, according to the invention is particularly directed to produce a metal sheet which is characterized by a center-line average surface roughness Ra within a range of 0.3 to 3.0 μm and a microscopic shape constituting the surface roughness being comprised of a trapezoidal crest sections having a flat top surface, groove like concave sections formed so as to be surrounded by a whole or a part of the crest section and a middle flat section formed between the crest sections outside the concave section so as to be higher than the bottom of the concave section and lower than or equal to the top surface of the crest section and satisfies the following relation.

$$0.85 < Sm/D < 3.0;$$

$$Sm - D < 450\ \mu m$$

$$30 < d_0 < 500\ \mu m$$

$20-\eta<95\%$ where Sm is the mean center distance between the adjacent crest sections, D is the mean diameter in the outer periphery of the concave section, $d_0$ is the mean diameter in the flat top surface of the crest section, and $\eta$ is a ratio of sum of the area in the flat top surface of the crest section and the area in the flat surface of the middle flat section to a whole area of the metal sheet.

On the other hand, in order to optimize the performance of the work roll set forth above and in order to form the above specified work roll, the diameter D of the ring-shaped crest is so determined in relation to the center-to-center distance Sm between adjacent uneven dulled sections as to satisfy the condition that the ratio Sm/D is in the range of 0.85 and 1.7 and that the difference (Sm−D) is less than 280 μm. In addition, the crest has a hardened surface layer.

On the other hand, in order to make the work roll for temper rolling set forth above, using a laser beam, the energy density of the laser beam is selected at an optimum value. The process of making the work roll may include a step of hardening the surface portion of the crest on the roll surface by way of subzero treatment.

According to one aspect of the present invention, a work roll for temper rolling a metal sheet comprises a peripheral surface formed with a plurality of uneven sections in a spaced apart relationship to each other, each uneven section being constituted of a depression and an annular ring shaped projection surrounding the depression, the uneven sections being arranged to have a ratio between center-to-center distance between adjacent uneven sections and the external dimension of the uneven section in the range of 0.85 to 1.7, and a difference between the center-to-center distance and the external size of less than 280 μm.

The work roll has a hardened surface layer at a position at least corresponding to the position of the projection. The surface portion of the work roll at the uneven section is constitued by a plurality of different composition layers, which include a first outermost layer having a given composition of martensite, a second layer next to the first layer containing martensite and ϵ (epsilon) carbide, and a third layer containing martensite and carbide. The first layer is in a thickness of a range 5 to 30 μm, the second layer is in a thickness of a range 5 to 30 μm, and the third layer is in a thickness of a range 5 to 30 82 m. The first layer also contains a given composition of austenite. If desired, the surface portion at the uneven section has a surface coat layer over the first layer. The surface coat layer may be formed by plating. Preferably, the plated surface coat layer is composed of a chromium.

On the other hand, the work roll has a contact area to actually contact a back-up roll during the temper rolling operation, on which contact area, a pressure lower than 1000 Kgf/mm$^2$ is exerted.

According to another aspect of the invention, a method for dulling a work roll for temper rolling a metal sheet comprises the steps of:

providing a material roll to be dulled and supporting the material roll;

driving a laser for irradiating a laser beam on a predetermined position of the outer periphery of the material roll for forming an uneven section constituted of a depression and an annular ring-shaped projection surrounding the depression, the laser beam being adjusted an energy density in the range of $5\times10^4$ to $9\times10^6$ W/cm$^2$; and performing a subzero treatment on the dulled roll surface for hardening the surface layer of the uneven section.

The method further includes the steps of driving the material roll to rotate at a predetermined rotation speed for forming a plurality of uneven sections which are circumferentially aligned; and causing relative displacement between the material roll and the laser in an axial direction for axially shifting the irradiation points for forming a plurality of uneven sections arranged in spaced apart relationship in an axial direction.

In practice, the method is designed for forming a peripheral surface formed with a plurality of uneven sections in a spaced apart relationship to each other, each of the uneven section being constituted of a depression and an annular ring shaped projection surrounding the depression, the uneven sections being arranged to have a ratio between a center-to-center distance between adjacent uneven sections and the external size of the uneven section in the range of 0.85 to 1.7, and the difference between the center-to-center distance and the external size smaller than 280 μm.

According to a further aspect of the invention, an apparatus for making a work roll for rolling of a metal sheet comprises a support means for supporting a material roll, a laser system for irradiating a laser beam on a predetermined position on the material roll so as to form uneven sections constituted of a depression and an annular projection surrounding the depression for dulling the surface of the work roll, and means for converting at least part of the austenite contained in the surface layer of the uneven section into martensite for hardening the surface layer.

The converting means performs a subzero treatment for converting the austenite into martensite. The laser system is adapted to generate a laser beam having an energy density in the range of $5\times10^4$ to $9\times10^6$ W/cm$^2$.

The apparatus further comprises first driving means for rotatingly driving the material roll on the support means at a controlled rotation speed, and a second driving means for causing relative displacement between the material roll and the laser system in an axial direction at a predetermined pitch. On the other hand, the apparatus may further comprise means for forming a wear-resisting plating layer on the surface of the uneven section or may further comprise means for performing a normalization treatment for the roll surface in order to adjust the contact area of the roll surface onto a back-up roll during temper rolling at a predetermined value. The normalization is performed for providing a contact area to actually contact with a back-up roll during a temper rolling operation, on which contact area a pressure lower than 1000 Kgf/mm$^2$ is exerted.

The apparatus can be associated with a control system which comprises a sensor means for monitoring the surface condition of the dulled material roll to produce a sensor signal, means for arithmetically deriving a value representative of surface condition of the dulled roll and comparing the derived value with a reference value for determining the condition of the dulling operation to be performed, based on the sensor signal, means for setting the derived dulling condition, and means for controlling the apparatus according to the set dulling condition.

In practice the sensor means comprises an image pick-up a device for picking-up video image of the roll surface for detecting its surface condition. The image pick-up device picks up a still image.

In the alternative, the sensor means comprises a contact needle type roughness gauge detecting uneveness of the roll surface according to a stroke of a needle contacting the roll surface. The sensor means also comprises a scanning control means for shifting the needle in a predetermined pattern for detecting surface conditions of the roll over a predetermined area.

BRIEF DESCRIPTION OF THE DRAWINGS

The present invention will be understood more fully from the detailed description given herebelow and from the accompanying drawings of the preferred embodiment of the invention, which, however, should not be taken to limit the invention to the specific embodiment, but are for explanation and understanding only.

In the drawings:

FIGS. 59 and 60 show examples of the relationship between the depth and hardness on the surface portion of the work roll;

DESCRIPTION OF THE PREFERRED EMBODIMENT

Figure 1:
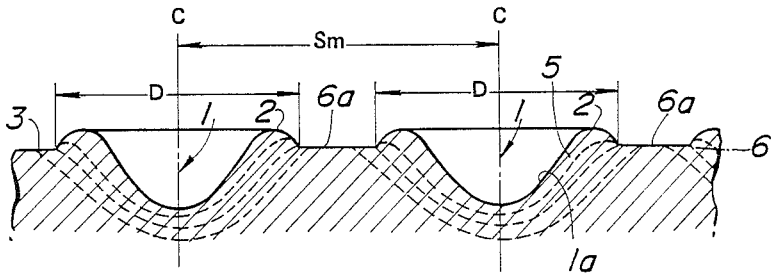
FIG. 1 is an explanatory and enlarged section of the preferred embodiment of a work roll which has a dulled surface, according to the present invention.

Referring now to the drawings, particularly to FIG. 1, the preferred embodiment of a work roll for temper rolling is dulled by means of a laser beam. The process and apparatus for laser beam dulling for the work roll will be described later.

Figure 2:
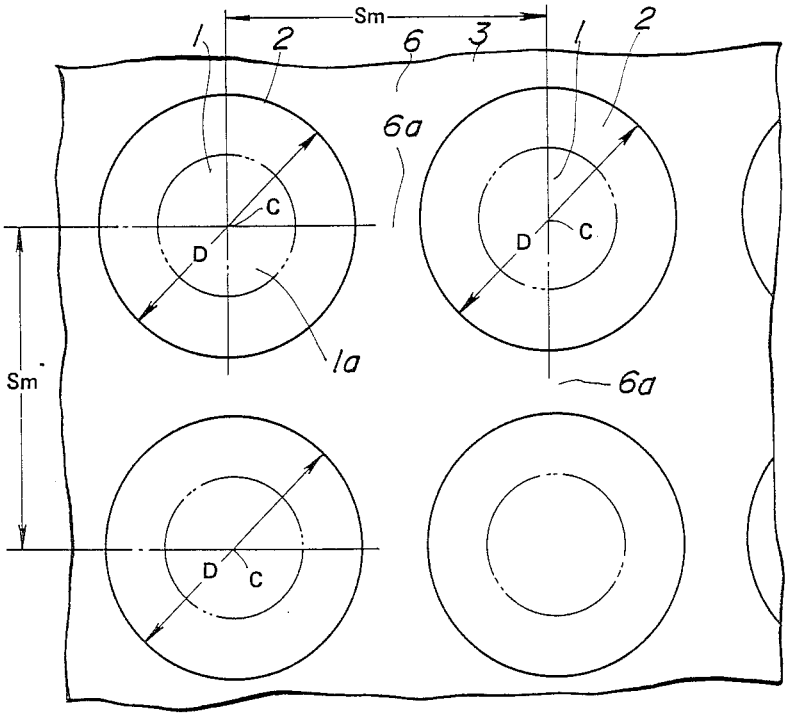
FIG. 2 is an enlarged plan view of the preferred embodiment of the work roll with dulled surface.
Figure 6:
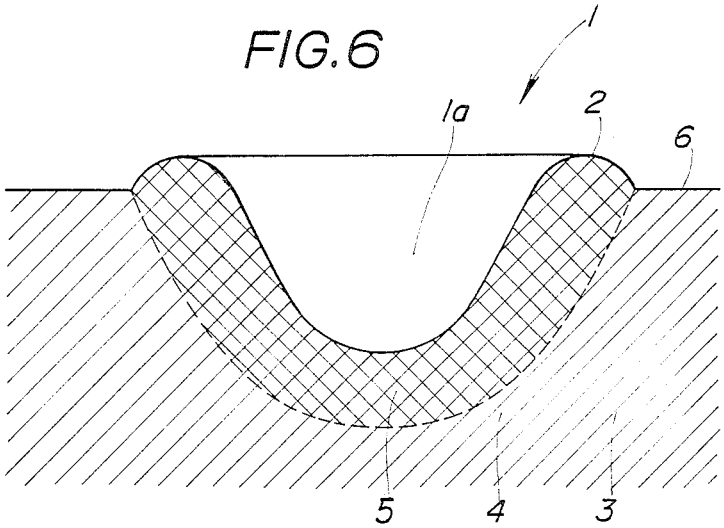
FIG. 6 is a diagrammtically sectioned view partially showing the dulled state of the work roll dulled through a laser beam as a high density energy source according to the invention.
Figure 7:
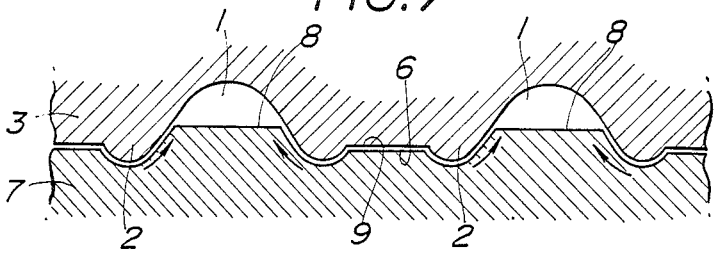
FIG. 7 is a schematic section of the work roll and a metal sheet in a temper rolling.
Figure 8:
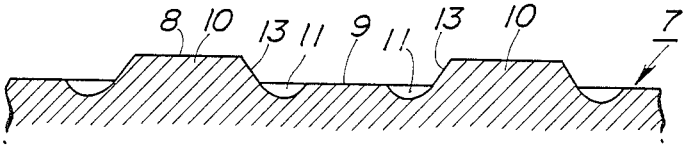
FIG. 8 is a schematic section of a metal sheet after temper rolling.

A laser beam is irradiated onto the surface of the rotating work roll in sequence to regularly fuse surface portions of the roll exposed to a laser energy, whereby plurality of crater-like uneven dulled sections 1 are formed on the surface 3 of the work roll in regularly and geometrically patterned fashion. As shown in FIGS. 1, 2 and 6, each uneven dulled section has a concave portion 1*a*. The fused metal base of the work roll heaves upwardly from the surface level 6 of the work roll in the form of a ring surrounding the associated concave portion 1. The heaved portion will be hereafter referred to as "annular crest" or "crest ring" throughout the disclosure and the annular crest is generally represented by the reference numeral 2. On the other hand, during irradiation of the laser beam in formation of respective crater-like uneven dulled sections 1, the metal is melted by the energy of the laser beam to form a heat-influenced layer 5 along the inner periphery of the concave portion 1*a*.

As shown in FIGS. 1 and 2, the shown embodiment, in which the centers C of respective uneven dulled sections 1 are aligned longitudinally and circumferentially with regular intervals Sm relative to adjacent uneven dulled sections of the work roll 3 is formed with the uneven dulled sections 1 with the concave portions 1*a* and the annular crests 2 in an arrangement, in which the crater-like uneven dulled sections 1 are longitudinally and circumferentially aligned with the adjacent uneven dulled sections with predetermined and regular center-to-center intervals Sm relative to the adjacent uneven dulled sections. The diameters of the concave portion 1*a* and the annular crests 2 as well as the depths of the concave portions are determined by the intensity and density of the laser beam to be irradiated onto the surface of the work roll 3. In the shown embodiment, the outer diameter D of the annular crest 2, which represents the outer extreme of the uneven dulled sectiona1, is selected in relation to the aforementioned center-to-center interval Sm, so that a surface level flat section 6*a* can be left between adjacent uneven dulled sections 1. The aforementioned uneven dulled sections 1 are regularly formed by regularly irradiating the laser beam while rotating or axially shifting the work roll, wherein the surface of the roll is rendered into a rough state rough the gethering of these formed uneven dulled sections. The rough state of the roll surface is shown in FIGS. 1 and 2. The intervals between the uneven dulled sections 1 can be adjusted by controlling the frequency of irradiation of the laser beam in relation to the rotating speed of the work roll and by controlling the pitch of axial shift of the irradiation point of the laser beam.

It should be appreciated that, although the invention has been described with respect to the use of a laser as a high density energy source, similar results are obtained when using a plasma or electron beams as a high density energy source.

As set forth, the depth and the diameter of the uneven dulled sections, which diameter is defined by the outer diameter of the annular crest 2, are determined by the intensity of the incident laser beam and the irradiation time, which gives a rougheness corresponding to the surface roughness Ra in a work roll dulled through the conventional shot blast process.

The base metal of the roll heated by the laser beam instantly changes into a metallic vapor due to the great energy density of irradiated laser beam. In this case, the fused metal is blown away from the roll surface by the generated vapor pressure to form the concave portion 1*a*. On the other hand, the blown fused metal again adheres to the circumference of the concave portion to form the annular crest 2 surrounding the concave portion. Such series of action are more efficiently performed by blowing an auxiliary gas, such as oxygen gas or the like to the reacting point.

A metal sheet, such as a cold rolled steel sheet to be temper rolled is, at first, subjected to annealing or other necessary treatment steps. After necessary treatment, the metal sheet is subjected to a rolling process at a light draft at the temper rolling stage utilizing the preferred embodiment of the work roll dulled as set forth above. During this temper rolling process, the dull pattern formed on the work roll surface is transferred to the surface of the metal sheet to thereby give a roughened surface to the metal sheet.

As will be microscopically observed at the metal sheet surface at the temper rolling stage, the annular crests 2 of the uneven dulled sections 1 are pushed onto the surface of the metal sheet 7 under a high pressure. This results in formation of local plastic flow of material in the vicinity of the surface of the metal sheet in a region in which the metal sheet material is softer than that of the work roll. Therefore, the metal of the metal sheet 7 flows into the concave portion 1*a* of the uneven dulled sections 1 to form a raised section 10 which will be referred to as a "crest". The crest 10 is of conico-cylindrical configuration to has a flat top surface 8. The top surface 8 of the crests thus formed on the metal sheet surface lie substantially parallel to the generally flat original surface of the metal sheet. On the other hand, sections 9 of the metal sheet 7 mate with the flat sections 6 of the work roll 3 and are depressed. This expands the height difference between the top of the crest 10 and the flat section 9. Between the crest 10 and the flat section 9, an annular groove 11 is depressingly formed by means of the annular crest 2 of the uneven dulled sections 1 of the work roll 3. After temper rolling, the metal sheet 7 is transferred the uneven dulled sections on the surface of the work roll 3 to have the crests 10 with flat top surface 8, the annular grooves 11 and the flat sections inbetween the pressed uneven dulled sections. The height level of the flat section 9 is higher than the bottom of the groove 11 and lower than or equal to the top surface 8 of the crests 10.

Figure 9:
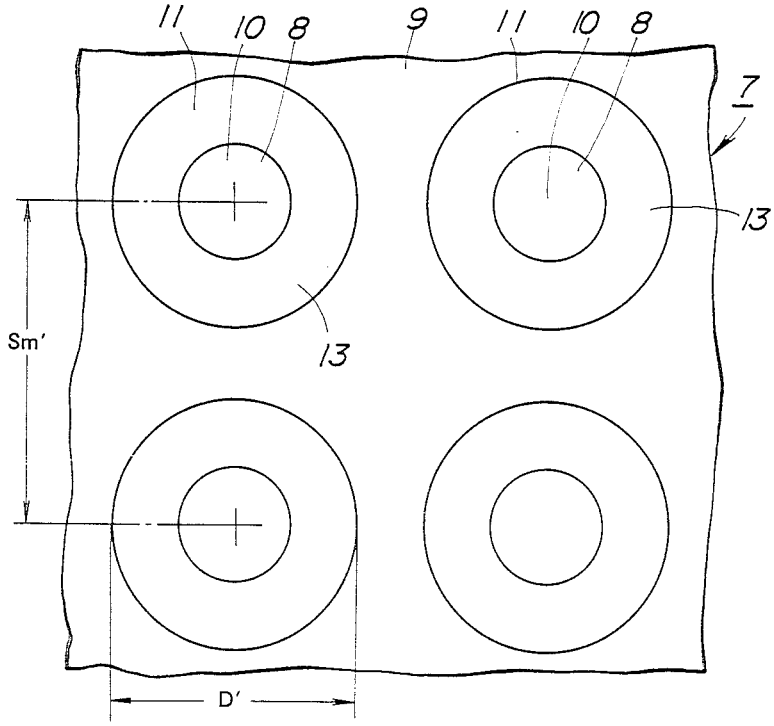
FIG. 9 is a plan view of the metal sheet of FIG. 7.

As seen from the above, the ratio of flat portions constituted by the flat top surface 8 of the crests 10 and the intermediate flat section 9 becomes greater on the metal sheet surface after temper rolling. This reduces the relative proportion of the sloped areas 13 in the transition between the flat top surface 8 of the crests 10 and the bottom of the groove 11. As shown in FIG. 9, the uneven dulled sections formed on the metal sheet 7 are so arranged as to have the equivalent regular and geometric pattern as that on the work roll 3. Namely, the center-to-center distance Sm′ of the adjacent uneven dulled sections on the metal sheets substantially corresponds to the center-to-center distance Sm of the adjacent concave portion 1a of the work roll. Similarly, the external extreme diameter D' of the annular groove 11 substantially corresponds to the external extreme diameter D of the annular crest 2 of the work roll 3.

Figure 3:
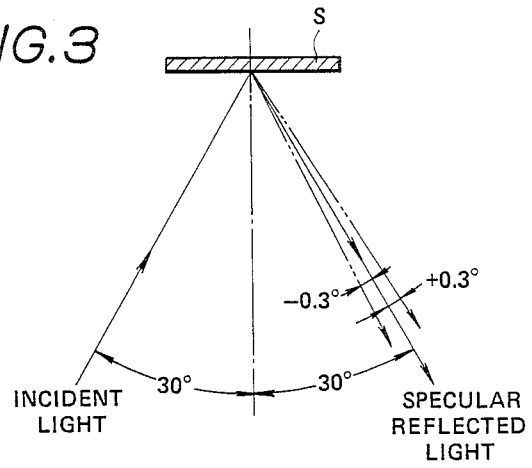
FIG. 3 is an explanatory illustration showing a manner of measurement of a distinctness of image.
Figure 4:
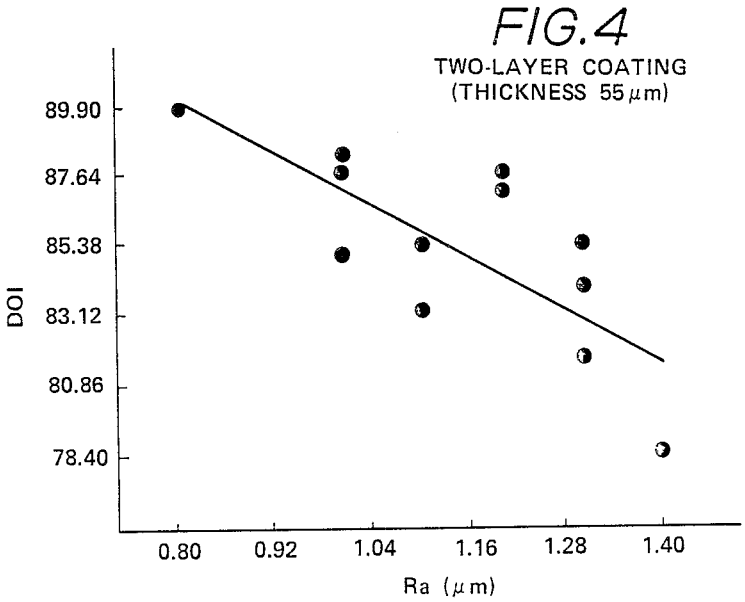
FIG. 4 is a graph showing a center line average roughness Ra and DIO value after painting on a steel sheet rolled by a beam of a work roll dulled by conventional shot blasting operation, in which the paint is provided as two-layer coating.
Figure 5:
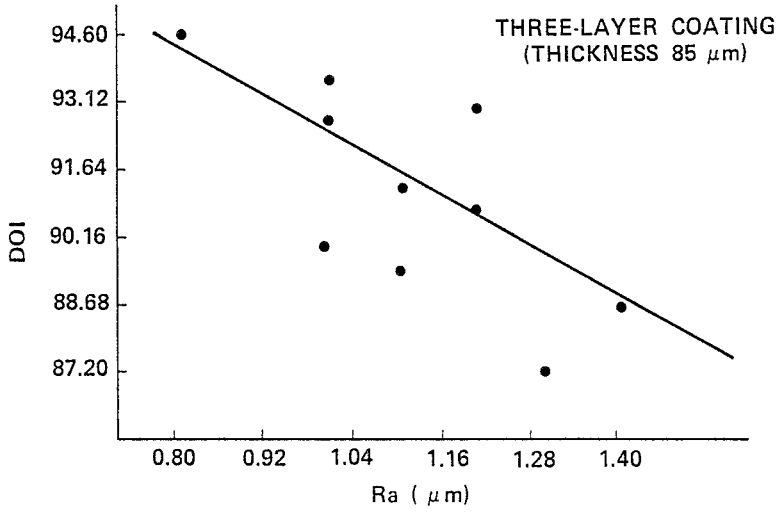
FIG. 5 is a graph showing a center line average roughness Ra and DIO value after painting on a steel sheet rolled by the beam of a work roll dulled by conventional shot blasting, in which the paint is provided as three-layer coating.

Here, the image distinctness of the metal sheet is illustrated by a so-called DOI value, namely or the value measured by means of a Dorigon meter made by Hunter Associates Laboratory. The DOI value is expressed as $DOI=100\times(Rs-R_{0.3})/Rs$, wherein Rs is the intensity of a specular reflected light when a light entered at an incident angle of 30° is reflected at a specular reflective angle of 30° with respect to a sample S, and $R_{0.3}$ is the intensity of the scattered light at a reflective angle of 30°±0.3°, as shown in FIG. 3. The relation between the DOI value indicating the distinctness of image and the center-line average roughness Ra is shown in FIGS. 4 and 5. FIG. 4 is a case where a two-layer coating of 55 μm in thickness is applied to a metal sheet temper rolled with a roll dulled through a conventional shot blast process, and FIG. 5 is a case where a three-layer coating of 85 μm in thickness is applied to the same metal sheet. It will be appreciated from FIGS. 4 and 5, that as the center-line average roughness Ra increases, the DOI value representing the distinctness of image is decreased to represents a lower distinctness of the image. The examples of FIGS. 4 and 5 will be compared with the DOI value variations in the painted metal sheet which is temper rolled by means of the preferred embodiment of the work roll 3 later.

Figure 10:
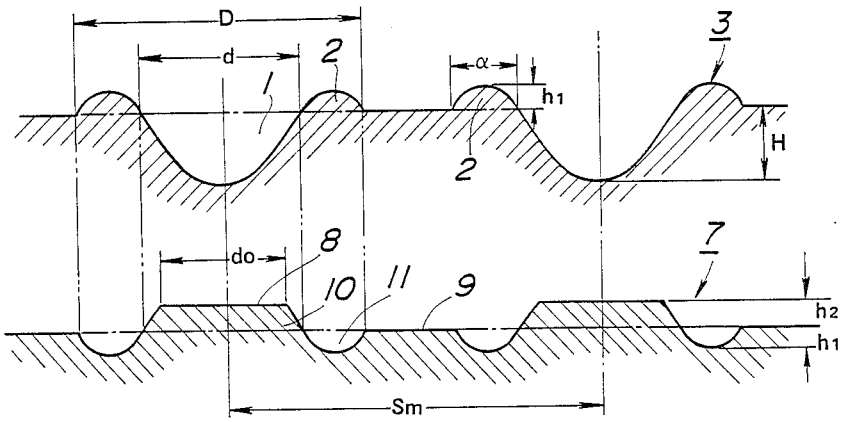
FIG. 10 is an explanatory and schematic sectional view of the work roll and the metal sheet, which shows the dimensional relationship between the work roll and the rolled metal sheet.
Figure 11:
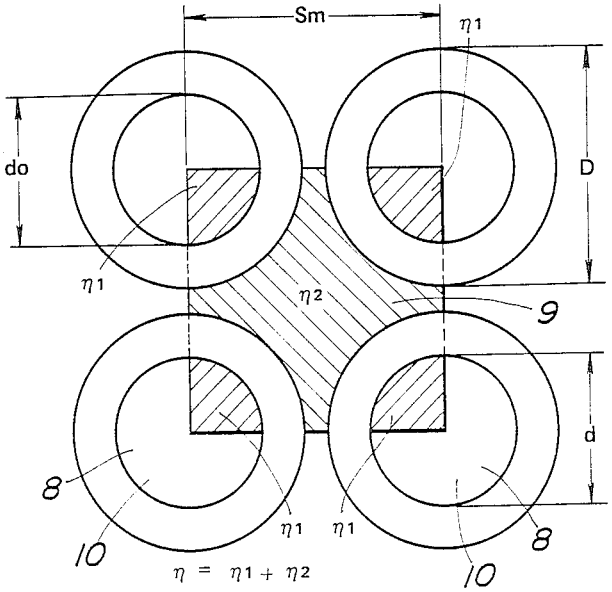
FIG. 11 is a plan view showing the relationship of the area $\eta_1$ occupied by the planar section of crest relative to flat area $\eta_2$ defined between adjacent uneven dulled sections.

The dimensions in each section of the dulled surface of the work roll 3 by the laser beam dulling process and the metal sheet temper rolled by means of the shown embodiment of the work roll are defined with reference to FIGS. 10 and 11 as follows:

D: represents the outer diameter of the annular crest 2 of the uneven dulled sectiona1 on the work roll surface or, on the other hand, represents the diameter of outer extremity of the annular groove 11 on the metal sheet, as set forth above;

d: represents the inner diameter of the annular crest 2 on the surface of the work roll 3;

$d_0$: represents the diameter of the flat top section 8 of the crest 10 on the metal sheet 7;

H: represents the depth of concave portion 1a of the uneven dulled section on the work roll surface;

$h_1$: represents the height of the annular crest 2 on the work roll surface and the depth of the groove 11 ranging from the height level of the intermediate flat section 9 to the bottom of the groove on the metal sheet;

$h_2$: represents the height of the flat top section 8 relative to the intermediate flat section 9 on the metal sheet;

α: represents the width between outer and inner extremities of the annular crest 2 of the uneven dulled section on the work roll surface; and Sm: represents the center-to-center distance between adjacent uneven dulled sections 1 on the work roll and, in turn, represents the center-to-center distance between adjacent crests 10 on the metal sheet.

The influence of the geometric pattern of the uneven dulled section constituting the surface roughness profile of the roll and temper rolling conditions upon the area ratio η of the flat surface sections of the metal sheet after temper rolling are examined based on the values set forth above. The area ratio η of the flat sections is represented by a sum value of the area occupation ratio $\eta_1$ of the flat top section 8 of the crest 10 on the metal sheet and the area occupation ratio $\eta_2$ of the intermediate flat section 9.

$$\eta=\eta_1+\eta_2 \quad (1)$$

Figure 12:
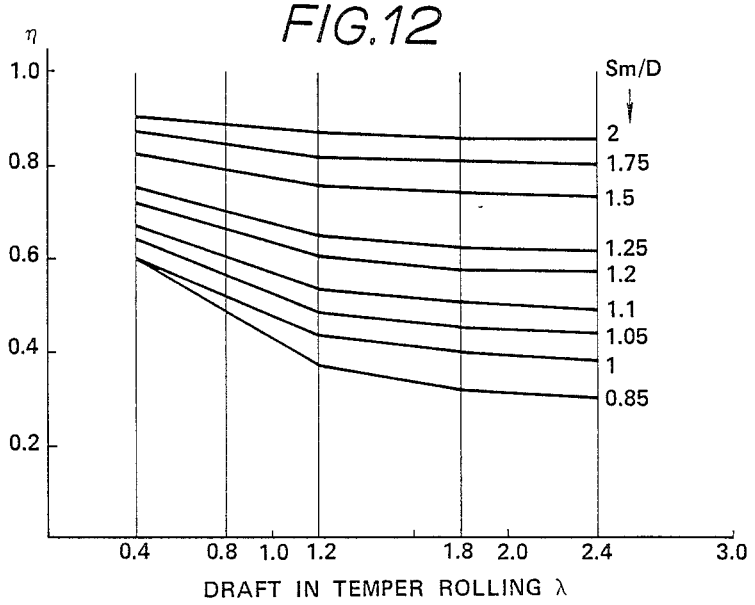
FIG. 12 is a graph showing the relation between the area ratio of flat portion $\eta$ at the metal sheet surface and the draft $\lambda$ in the temper rolling in accordance with the value of Sm/D.

Moreover, the value of $\eta_1$ varies in accordance with the draft in the temper rolling, because the degree of flow of metal in the metal sheet into the concave portion 1a of the uneven dulled section of the work roll is differentiated in accordance with variation of the draft. Hence, the diameter $d_0$ of the flat top surface 8 of the crest 10 changes. On the other hand, the value $\eta_2$ is held constant as determined according to the Sm/D value. In the preferred embodiment, the ratio of Sm/D is set in a range of greater than or equal to 0.85 and and smaller than or equal to 2.0. In order to perform experimentation, a steel work roll for temper rolling is used. Draft is performed at a thickness reduction ratio in a range of 0.4% to 2.4%. The area ratio η of the flat sections, i.e. the area ratio $\eta_1$ of the flat top sections 8 and the area ratio $\eta_2$ of the intermediate flat sections 9, in the temper rolled metal sheet 7 is measured. The result of the measurement is shown in FIG. 12. As will be seen from FIG. 12, the area ratio η of the flat sections varies significantly depending upon the Sm/D ratio.

Figure 13:
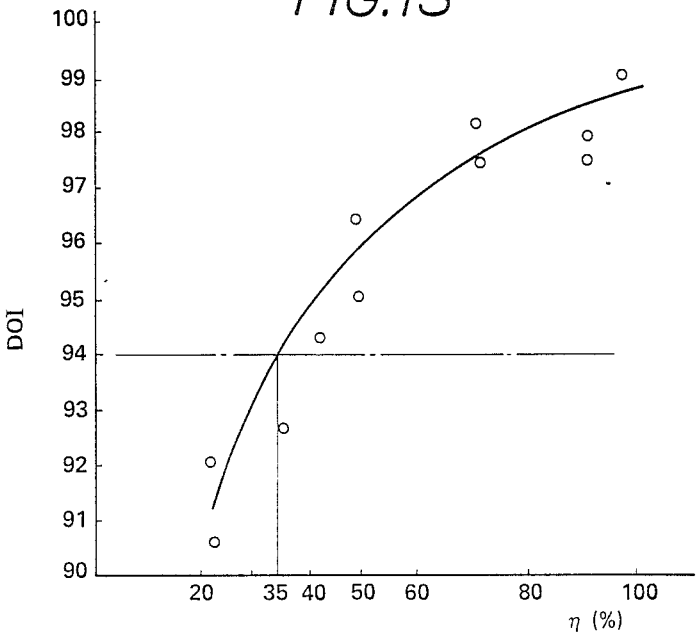
FIG. 13 is a graph showing a relationship between the area ratio of flat portion $\eta$ of the metal sheet and the DOI value after painting in case of three-layer coating.

Another experimentation is performed to transfer the uneveness on the work roll surface, in which uneveness determining parameters Sm, D and d are varied at various values. Furthermore, the draft λ in the temper rolling is varied. By varying the parameters set forth above, various area ratios η of the flat sections of temper rolled metal sheets are prepared. Three-layer coating with black paint is performed for the temper rolled metal sheets. The DOI value was measured with respect to each three-layer painted metal sheet. The result of the measurement is shown in FIG. 13. As will be appreciated from FIG. 13, the DOI value increases according to increasing of the area ratio η of the flat sections. In general, it is desirable that the DOI value is not less than 94% for giving satisfactorily quality to give a good impression in appearance when it is applied to the automotive vehicle as a vehicular outer panel. For this purpose, it is desired that η is not less than 35%. When the high image distinctness is required, however, η will be sufficient to be no less than 20%.

The dimensions determining the image distinctness, such as S, Sm, H and so forth in the surface roughness profile of the work roll defined as set forth above, can be varied by adjusting the dulling conditions of the work roll for temper rolling in the laser beam dulling operation. For example, such adjustment can be performed by adjusting the rotation speed or number of rotations of the work rolling in dulling, frequency of irradiation of the laser beam, intensity and density of the laser beam, speed of axial shift of the irradiation point of the laser beam on the work roll surface, the irradiation period of the laser beam, the blow condition of auxiliary gas, such as oxygen gas, and so forth. If it is intended to temper roll the usually formable cold rolled metal steel by means of the work roll dulled to Ra of 0.5 to 5 μm by means of the laser beam, the surface of the work roll has the annular crests 2, and each has the width α in a range about 20 to 40 μm and the height $h_2$ in a range of 5 to 30 μm.

Figure 14:
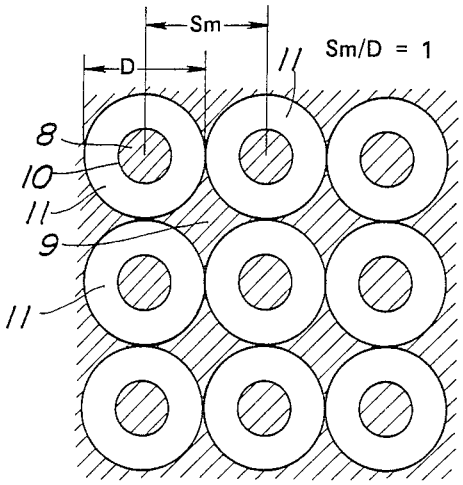
FIGS. 14, 15 and 16 are a schematic plan view showing variations of roughness pattern in the flat surface of the metal sheet as varying the Sm/D ratio.
Figure 15:
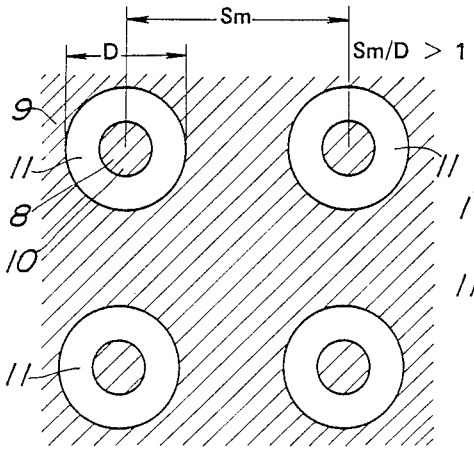
Figure 16:
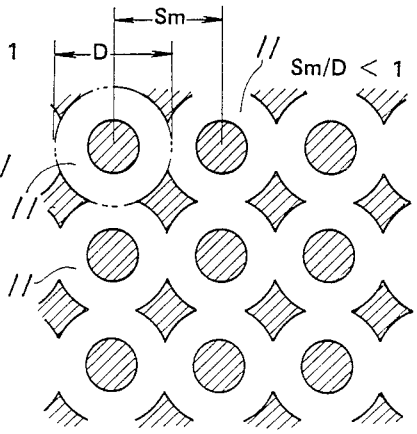

In the surface roughness profile formed on the metal sheet, three patterns as shown in FIGS. 14, 15 and 16 are obtained in accordance with the Sm/D ratio. That is, when Sm/D is set at 1, the adjacent grooves 11 just adjoin each other, as shown in FIG. 14. When Sm/D is greater than 1, the adjacent annular grooves 11 are separated from each other as shown in FIG. 15. On the other hand, when the Sm/D is smaller than 1, the adjacent annular grooves 11 overlap with each other, as shown in FIG. 16.

Thus various patterns of the surface roughness profile can be obtained by varying the Sm/d ratio. In this connection, work rolls for temper rolling having various Sm/D ratio were prepared by means of a laser beam. Utilizing the prepared work rolls, formation of dull pattern on the coil rolled steel sheet after anealing was performed by temper rolling at a proper draft. Thereafter, the dulled steel sheet was subjected to a press forming test and a painting test, from which the following were obtained.

Figure 17:
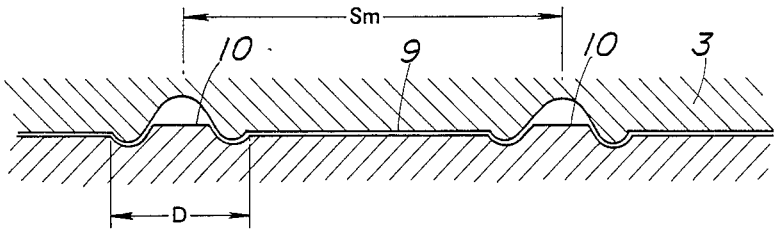
FIG. 17 is a diagrammatically sectioned view of a microscopic profile at the surface of work roll and the metal sheet when the Sm/D ratio is excessive.
Figure 18:
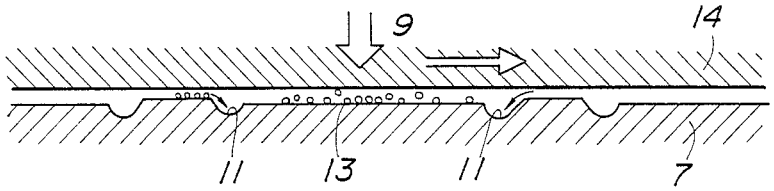
FIG. 18 is a schematic view of the metal sheet which is subjected to a press forming process.
Figure 24:
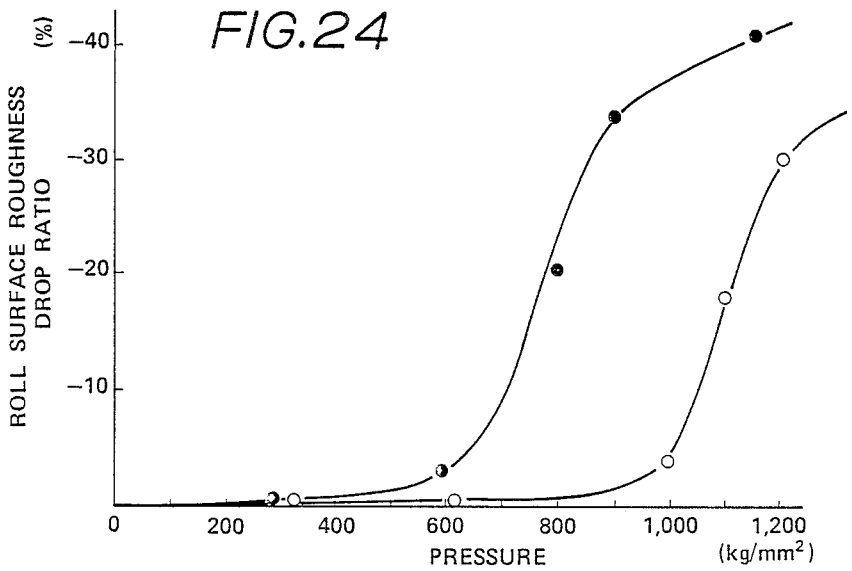
FIG. 24 is a graph showing the relationship between the actual contact pressure between the work roll and the back-up roll and the lowering magnitude of roughness on the work roll after temper rolling of 2 km of metal sheet.

When steel sheet 7 is temper rolled with the work roll 3, as shown in FIG. 17, as the value of Sm/D in the work roll becomes considerably large, the area of the intermediate flat section 9 existent between the adjacent crests 10 on the rolled steel sheet is subject to a press forming as shown in FIG. 24, metallic debris 13' exfoliated at the wider intermediate flat section 9 during the press forming are difficult to be trapped by the groove 11 and remain between the press tool 14 and the intermediate flat section 9. Furthermore, the feature that Sm/D is considerably large means that the space of the groove 11 acting to reserve a lubricating oil becomes relatively small and is apt to cause poor lubrication. Therefore, when the Sm/D ratio is too large, galling and baking is liable to be caused in the press forming.

On the other hand, it is required to control the width of the intermediate flat section 9 or the absolute value of Sm-D. Namely, the size of the annular crests 2 on the work roll 3 in the laser beam dulling process, i.e. the width $\alpha$ and the height $h_1$ are related to the fact that a part of the metal in the concave portion 1*a* fused by the laser beam heaves up at its circumference and is resolidified. When D is large, $\alpha$ and $h_1$ also become large. That is, when D is large, the capacity of reserving a lubricating oil in the press forming and the capacity of trapping exfoliated metallic debrics become large, which is significant for preventing galling and baking. However, the effectiveness is restricted to such a case that the concave portion such as the groove 11 capable of trapping exfoliated metallic debris is existent on the surface of the material to be worked in such a relatively sliding length between the press mold and the material that the exfoliated metal debris gradually deposits and finally causes galling and baking. In order to satisfy this requirement, it is necessary that the absolute value of the width (Sm−D) of intermediate flat section 9 is made smaller than a certain value.

Figure 19:
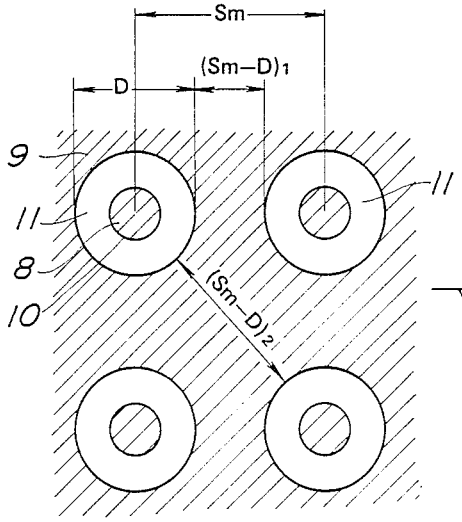
FIG. 19 is a schematic plan view showing the dimensional relationship adjacent uneven dulled sections.

In this respect, it has been found from the foregoing experimentation, that, in case of steel sheets have not a very high formability, which are used as an outer panel for automotive vehicle requiring particularly high distinctness of image, since the strain ratio in press forming is within 10%, unless the value of Sm/D exceeds 1.7, the galling and baking is not frequently caused in press forming. It is also found that, in order to prevent galling and baking, the absolute value of the width (Sm/D) of the intermediate flat section 9 must be less than or equal to 280 μm. The part of the results derived from the foregoing experimentation is shown in the appended table 1. It should be noted that, in the appended table 1, values $(Sm-D)_1$ and $(Sm-D)_2$ are as illustrated in FIG. 19.

On the other hand, the Sm/D ratio is closely related to the area ratio $\eta$ of the flat sections on the metal sheet, as set forth above. Namely, the distinctness of the image becomes higher as the area ratio $\eta$ becomes larger. Therefore, in order to obtain higher image distinctness, it is clearly desirable to have a greater area ratio $\eta$ which in turn means a large flat section area. On the other hand, for prevention of galling and baking, an excessively large flat section is not desirable. In this view, and as will be appreciated from the appended table 1, the acceptable maximum area ratio $\eta$ of the flat sections is approximately 85% and the maximum Sm/D ratio is 1.7 as will be seen from FIG. 12.

Accordingly, in the preferred embodiment, the upper limit of the Sm/D value is set at 1.7. In addition, the preferred distance (Sm−D) is less than 280 μm. On the other hand, if the Sm/D ratio is set at less than 0.85, the dulling operation by means of a high density energy source, such as a laser beam and so forth, for forming uneven dulled sections, becomes unstable. This makes it difficult to control the Ra roughness. Therefore, the lower limit is set at 0.85.

In general, a typical material for making the work roll is a hardened forged roll steel containing a high composition of C and Cr. The roll steel is subject to oxidation treatment, and to hardening treatment under conditions precipitating fine carbide, and Cr carbide is precipitated during oxidation. The surface portion in a depth of 50 to 100 mm of the material roll is composed of martensite indused by hardening treatment. The hardened material roll is tempered at low temperature. Therefore, before the laser beam dulling operation, the surface portion of the material roll is composed of a mixture of martensite and $\epsilon$ carbide.

Figure 20:
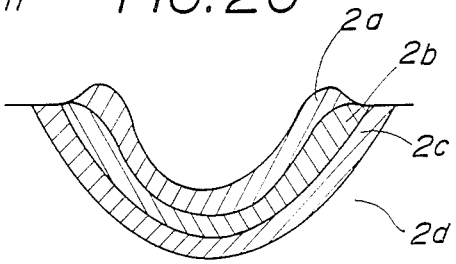
FIG. 20 is a schematic section of the work roll which is processed by subzero treatment after the dulling process by means of a laser beam.

Irradiating the laser beam onto the surface of the material roll, the metal at the irradiation point is melted or fused to cause vaporization to form the annular crest 2 around the concave portion 1*a* where a certain amount of metal is removed. The periphery of the concave portion 1*a* and the annular crest 2 is generally separated into three layers depending on the magnitude of influence of the heat in the dulling operation, as shown in FIG. 20. The uppermost layer $2_a$ is a molten metal layer. In this layer, the precipitated carbide and Cr carbide are melted into the base material to lower the Ms point (which is a temperature criterion to form martensite) to be lower than the atmospheric temperature. As a result, when the roll surface is cooled at the normal or atmospheric temperature, a relatively large amount of unmartensited austinite is contained. Therefore, the hardness of this layer is 450 to 550 Hv.

On the other hand, the second and intermediate layer is a layer heated at about 900° C. which substantially corresponds to the hardening temperature. The layer is rapidly cooled to the atmospheric temperature to be again hardened. By this, this layer becomes a martensite layer containing $\epsilon$ carbide. This layer has a hardness in a range of 800 Hv to 900 Hv.

The third and innermost later is a layer heated at a temperature of 800° to 400° C. The layer is tempered by relatively high temperature heat to precipitate C and Cr. This layer has a hardness in a range of 650 Hv to 750 Hv. Beneath the third and innermost layer, there is a base material layer which is not influenced by the dulling heat and thus has a hardness in a range of 800 Hv to 900 Hv.

The laser beam to be used for the dulling operation is in a range of 600 W to 2500 W. If a laser beam of lower than 600 W is used, the laser beam energy will be insufficient satisfactorily to fuel the base metal to form the desired uneven dulled sections. On the other hand, when the laser beam energy is higher than 2500 W, thermal deformation tends to occur on the lens in the laser machine to cause instability in the laser mode to cause difficulty in roughness control.

Utilizing a laser of 600 W to 2500 W, the dulling operation is performed in a condition that the irradiation period for each irradiation point is in a range of 30 to 100 μsec. By this operation, the diameter D of the concave portion 1a varies within a range of 120 μm to 350 μm.

In this case, the thickness of the three layers varies depending on the laser beam energy to be applied. Namely, when the laser beam is irradiated for a period of 30 μsec to 100 μsec at each irradiation point, the thickness of respective three layers becomes about 5 to 15 μm when 600 W laser is used, and at 20 to 30 μm when 2500 W laser is used.

As set forth above and as shown in FIG. 20, the annular crest 2 in the uneven dulled section is formed by the first and outermost layer 2a containing austenite and has a hardness of 450 Hv to 550 Hv. Therefore, the annular crest 2 is rather soft. This rather soft layer is subject to rolling pressure while temper rolling is performed utilizing this work roll in the aid of the back-up roll. This causes plastic deformation to lower the height of the crest 2 according to expansion of the rolling length.

Since the annular crest 2 is formed of relatively soft material, the height of the annular crest can easily lowered to the acceptable height so as not to maintain the necessary depth of the groove to be formed on the metal sheet. This makes it impossible to maintain the necessary roughness on the work roll surface. Therefore, replacing of the work rolls becomes essential to maintain satisfactorily high quality product from the temper rolling process.

In order to slow-down the lowering speed of the height of the annular crest 2, a hardening treatment has to be performed on the annular crest. According to the shown embodiment, the work roll 3 dulled by beams of the laser beam is thus subjected to subzero treatment.

Figure 21:
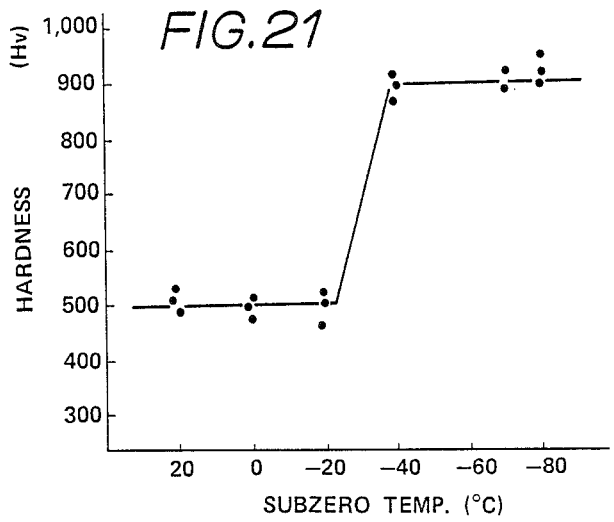
FIG. 21 is a graph showing the relationship between the temperature of the subzero treatment and the magnitude of hardening of the roll surface.

Namely, during the laser beam dulling operation, the Mf point, at which formation of the martensite is completed, is significantly lowered by resolution of the C and Cr carbide into the base metal. The temperature reduction is substantial and the Mf point drops below the atmospheric temperature. Therefore, by performing a subzero treatment at a temperature lower than 0° C., the austenite contained in the first layer 2a is changed into martensite to harden the annular crest 2. Relationship between the temperature of the subzero treatment and the hardness of the annular crest 2 is illustrated in FIG. 21. Namely, when the temperature of the subzero treatment is in a range of 20° C. to −20° C., no change has been observed in the first layer 2a constituting the annular crest 2. When the temperature of the subzero treatment is performed at a temperature lower than or equal to −40° C., the hardness of the first layer 2 becomes increased about 900° C. This proves that sufficiently high hardness can be obtained by performing subzero treatment at a temperature lower than or equal to 900° C.

It should be noted that when the subzero treatment is completed to constitute the first layer 2a as the pure martensite layer, though the hardness becomes high, the strain resistance become lowered to become brittle. Therefore, the possibility of breakdown of the annular crest during the temper rolling operation increases.

Figure 22:
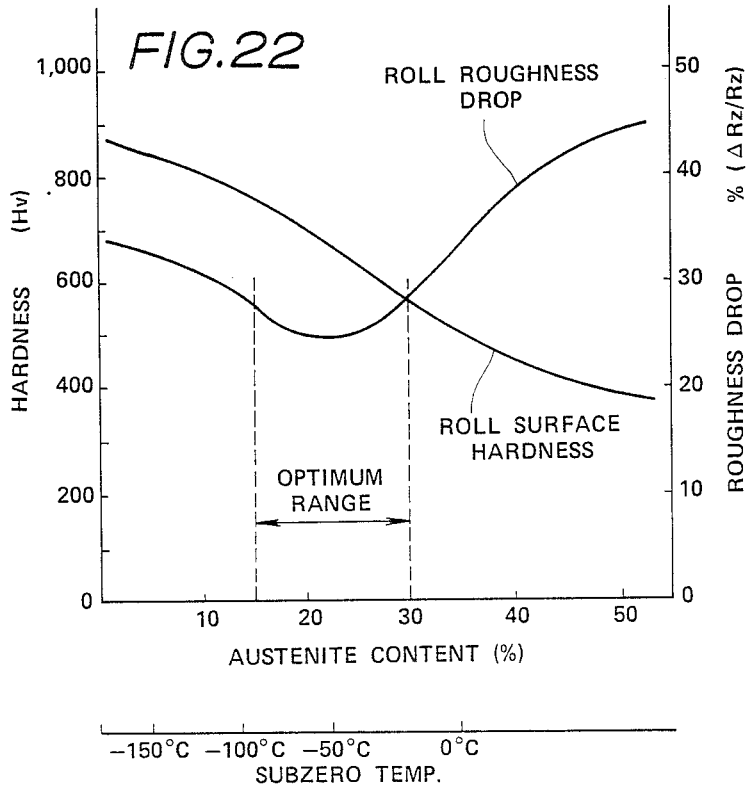
FIG. 22 is a graph showing the amount of austenite, hardness and lowering magnitude of roughness after subzero treatment.

FIG. 22 shows the relationship between the amount of the austenite, the hardness and roughness drop. In order to measure the drop of the roughness, temper rolling of hoop iron or band steel of the length of 60 Km is performed at a draft speed 100 m/min.

As will be seen from FIG. 22, when the amount of the austenite is less than or equal to 15%, brittleness of the annular crest 2 becomes unacceptable high though the hardness is satisfactorily high. This increases the possibility of breaking down on the annular crest to increase the possibility of significantly lowering the roughness. On the other hand, when the amount of the austenite becomes greater than 30%, hardness of the annular crest 2 becomes insufficient to cause lowering of the height at an unacceptable level in an unacceptably short period. From the above discussion, it should be appreciated that the composition of the austenite in a range of 15% to 30% exhibits the best balance of the life of the annular crest and brittleness can be obtained. Therefore, the subzero treatment has to be performed to maintain the austenite in a composition range of 15% to 30%.

The subzero treatment can be performed in any known ways. For example, a subzero treatment can be performed by dipping the laser beam dulled work roll into liquid nitrogen. Otherwise, subzero treatment can also be performed by dipping the roll into a dry-ice liquid.

On the other hand, there are known technics for providing a surface hardening layer, such as plating on the roll surface in order to reduce wearing. For example, it is possible to substantially reduce wearing by surface treatment, such as forming a Ti coating layer, by way of Cr plating, metal composition plating, an ion plating. In case of Cr plating, a substantially hard layer having a hardness of 950 Hv to 1050 Hv can be obtained. However, if the surface coating layer is formed by Cr plating on the annular crest 2 which is not subject to hardening treatment, i.e. subzero treatment, the annular crest 2 beneath the plating coat layer tends to subject concentrated pressure during temper rolling through the back-up roll. This causes separation between the crest surface and the coat layer to cause cracking in the coat layer. Therefore, even when the plating coat layer is formed, it is essential to perform a hardening treatment for the annular crest 2 per se before formation of the coat layer. This results in pilling off of the coat layer. Once pilling off of the coat layer occurs, the lowering of roughness is accelerated at a higher rate than that caused on the annular crest which is not processed.

When a Cr plating coat layer is formed on the the work roll 3 which is dulled by means of the laser beam and therafter subjected to subzero treatment, the Cr plating coat layer of the hardness of 1050 Hv is formed on the first martensite layer 2a formed through the subzero treatment and having a hardness of 900 Hv, at the annular crest 2. As set forth above, the second and intermediate martensite layer 2b of hardness of 900 Hv and the third and inner most tempered layer 2c of hardness of 750 Hv and the base metal layer of hardness of 850 Hv are laminated in order. In this case, the third tempered layer 2c has the lowest hardness. However, since the third layer 2c is oriented away from the surface, it will not be subject to the rolling pressure in such a magnitude that the third layer may cause plastic distortion. As a result, the plastic deformation of the annular crest 2 is reduced and occurs uniformly. This substantially reduces the possibility of pilling off of the Cr plating coat layer. Therefore, the wear resistance of the Cr plating coat layer can be effective in such arrangement.

It should be noted that, in order to make the wear resistance of the plating coat layer, a 1 μm thick layer would be sufficient. However, in the preferred embodiment, the plating coat layer is set at a thickness of 5 μm to 15 μm. If the thickness of the plating coat layer is less than 1 μm, the plating coat layer will be rapidly worn upon initiation of temper rolling so as not to effective. On the other hand, when the thickness of the plating coat layer becomes greater than 15 μm, adherence ability of the plating coat layer becomes lowered to easily cause pilling off. On the other hand, when a TiN coat layer is formed by way of ion plating, the plating coat layer may have a preferred thickness of 1 μm. Lesser thickness will not be effective because such thin coat layer may be easily worn off during the temper rolling operation. On the other hand, a thickness of the TiN plating coat layer in excess of 5 μm may not be used in the viewpoint of cost.

As set forth, during the temper rolling operation, the work roll 3 contacts the back-up roll. When the surface of both work roll and the back-up roll are flat, the contact area A can be illustrated by:

$$A = W \times L$$

where W is the width of the roll in contact with the other and L is an axial length of the work roll.

The contact pressure between the work roll and the back-up roll during temper rolling is called the hertz pressure. Normally, the hertz pressure in temper rolling is in a range of 40 to 60 Kgf/mm$^2$. On the other hand, in case of the temper rolling by means of the preferred embodiment of the work roll dulled through the laser beam dulling process, the load concentrates at the annular crests 2 of the uneven dulled sections on the work roll 3. In order to reduce wearing of the work roll, particularly of the annular crests, it would be effective to reduce the pressure load at an unit area.

Figure 23:
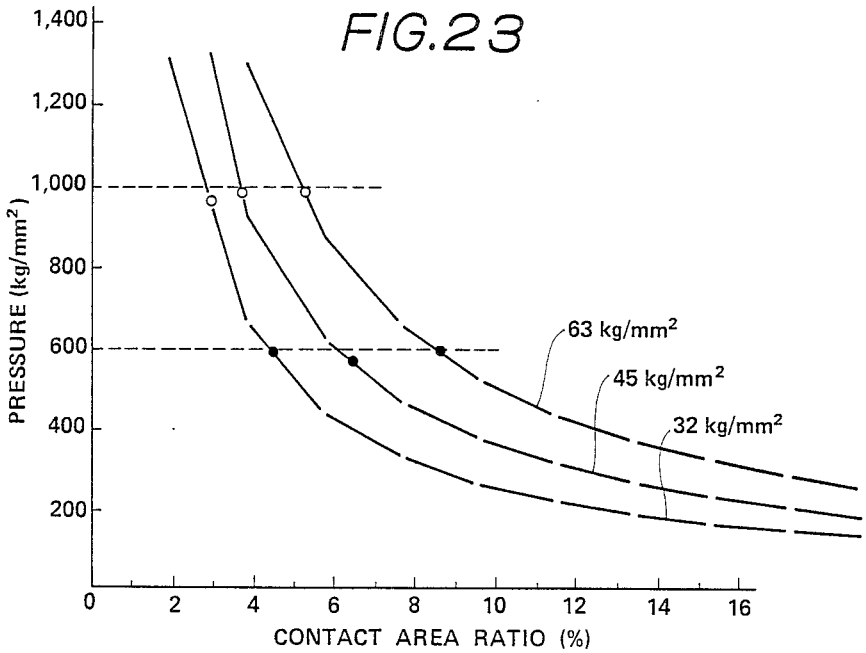
FIG. 23 is a graph showing the relationship between the contacting area ratio between the work roll and back-up roll and actual contact pressure, at a given load.

FIG. 23 shows a variation of the actually applied load onto the annular crest 2. In FIG. 23, the horizontal axis indicates an area ratio of the annular crest 2 relative to overall contact area. The contact area of the annular crest 2 will be hereafter referred to as 'actual contact area'. The word 'actually applied load' represents a pressure load applied to the unit area of the annular crest 2.

In order to perform experimentation, six sets of rolls are provided. Each work roll in the sets of rolls are dulled at 230 μm pitch by means of the laser beam. Among six work rolls, three rollers are left being not treated after the laser beam dulling process. Remaining three work rolls are subject to subzero treatment for hardening the surface layer of the annular crest. Utilizing these rolls, an experimental temper rolling operation is performed by means of a tandem type rolling mill. Hertz pressure is varied at 32 Kgf/mm$^2$, 45 Kgf/mm$^2$ and 63 Kgf/mm$^2$. The temper rolling is performed on five coils (100t) of SPCC material.

In the observation of the experimental temper rolling, it is found that lowering of the dulled surfaces on the work rolls 2 was significant in rolling of the first coil. After completing temper rolling for five coils, the roughness variation becomes substantially small. At this condition, the actual contact area between the work rolls and back-up rolls are measured. In addition, actually applied pressure load at respective hertz pressure are measured. In FIG. 23, the plots with black circles show the measured values measured with respect to the work rolls to which subzero treatment was not performed, and the plots with white circles show measured values measured with respect to the work rolls to which the subzero treatment was performed. On either case, the contact area ratio before rolling operation was in a range of 1 to 2%.

As seen from FIG. 23, in the temper rolling with the hertz pressure of 63 Kgf/mm$^2$, the contact area ratio increases up to about 8 to 9% at relatively high speed. This means rather great magnitude of plastic deformation occurs at the initial stage of rolling to lower the height of the annular crest 2. After reaching the 8 to 9% of the contact area ratio, increasing ratio of the contact speed becomes saturated. From the experimentation, it has been found that even at various hertz pressures the plastic deformation of the annular crests 2 becomes saturated at a specific actual load pressure on the unit area of the annular crest. Namely, in case of the work roll which has not been treated by subzero treatment and thus has a relatively soft surface layer, the plastic deformation saturates at an actually applied pressure of 600 Kgf/mm$^2$. On the other hand, in case of the work roll which is treated by subzero treatment and thus has a hardened surface layer on the annular crest, the saturation of the plastic deformation on the annular crest 2 occurs at the actually applied pressure of 1000 Kgf/mm$^2$.

In addition, when surface normalization treatment is used for making the height of the annular crests substantially even, the magnitude of the plastic deformation can be reduced. Therefore, even for the work roll dulled by means of the laser beam and not given subzero treatment, lowering the magnitude of the roughness of the dulled work roll can be significantly reduced by performing surface normalization and by adjusting the actually applied pressure load at a pressure lower than or equal to 600 Kgf/mm$^2$. Similarly, by performing, a surfacing normalization treatment for the dulled work roll with hardened surface by way of subzero treatment, and by maintaining the actually applied pressure load lower than or equal to 1000 Kgf/mm$^2$, lowering of the roughness on the roll surface can be considerably reduced.

In the preferred process, the normalization of the work roll for making the height of the annular crests even, is performed by means of a kiss roll at various loads. Preferably the surface normalization treatment may be performed in advance of subzero treatment.

In order to test the property of the normalized roll, another experimentation is performed. For using in the experimental temper rolling, a work roll was dulled by means of laser beam and thereafter normalized by means of a kiss roll. Some of the work rolls are then subjected to subzero treatment. Utilizing the work rolls thus prepared, temper rolling for 2 km length of the hoop metal is performed at a draft speed 100 m/min. For each work roll different load pressures are exerted in the temper rolling. After the rolling operation for 2 Km length of hoop metal, the roughness drop (Rz) is checked. The result has been shown in FIG. 24.

In FIG. 24, the horizontal axis shows the actual load pressure derived by dividing the rolling pressure by the overall contact area of the annular crest 2 as contacted with the back-up roll. As the contact area, the contact areas of the annular crests 2 after surface normalization are used. On the other hand, the vertical axis shows roughness variation of the roll surface after temper rolling of 2 Km of hoop metal. In FIG. 24, the plots with black circles show the measured values measured with respect to the work rolls to which subzero treatment was not performed, and the plots with white circles show measured values measured with respect to the work rolls to which the subzero treatment was performed. As will be seen from FIG. 24, when the actually applied load pressure at the unit area of the annular crests 2 is in excess of 600 Kgf/mm$^2$, roughness on the roll surface of the work roll which is not treated by the subzero treatment, is significantly lowered. On the other hand, in case of the work roll subjected to the subzero treatment, the roughness on the roll surface was lowered after the actually applied pressure became higher than or equal to 1000 Kgf/mm$^2$.

Figure 56:
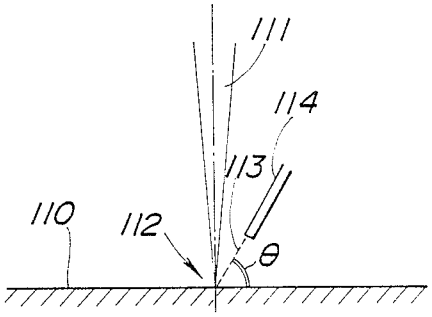
FIG. 56 is an illustration showing the relationship between the roll surface and a nozzle for discharging an assist gas.

Adjustment of the actual contact area for adjusting the actually applied load pressure to be lower than the aforementioned pressure criteria can be done by the following process:

(1) the work roll dulled by means of the laser beam is driven in contact with a kiss roll which has lower roughness than that of the work roll, at a hertz pressure lower than or equal to 60 Kgf/mm$^2$;

(2) the height of the annular crests on the work roll is ground by means of sand paper, grindstone or so forth to make the heights of the all the crests even;

(3) by performing light shot blast, sand blast or so forth, the annular crests 2 are ground to make the heights even; or (4) by means of the laser beam, the circumferential length of the peak of the annular crest is adjusted to be greater than or equal to 60% of the circumferential length of the overall uneven dulled section 1; for this purpose, the discharge angle $\theta$ (shown in FIG. 56) of the assist gas is selected to be 60° to 90°.

EXAMPLE 1

A first example is directed to employ a work roll of 70 mmϕ and a back-up roll of 140 mmϕ. The rolls are set in a small-size four high mill. The work roll to be employed in this example is prepared according to the present invention and has the following composition:

C: 0.85 Wt%
Si: 0.8 Wt%
Mn: 0.4 Wt%
Ni: 0.15 Wt%
Cr: 2.9 Wt%
Mo: 0.29 Wt%
V: 0.01 Wt%

This composition of the work roll is usual composition of the material for forming work roll for rolling. As a laser beam, pulsatile $CO_2$ gas laser beam is used. The laser beam is irradiated onto the roll surface for performing dulling operation at a predetermined roughness in the following irradiation condition:

laser energy: 2 kW
energy density: $6.4\times10^6$ W/cm$^2$
irradiation period: 50 μsec/pulse By irradiating the laser beam in the above-mentioned condition, the uneven dulled sections 1 are formed on the surface of the work roll 3. The uneven dulled sections 1 formed on the work roll surface are patterned as follow:

pitch of uneven dulled sections: 250 μm in both circumferential and axial directions;
diameter of the uneven: 180 μm $$Sm/D \approx 1.4$$

$$Sm-D=70\ \mu m$$

Figure 25:
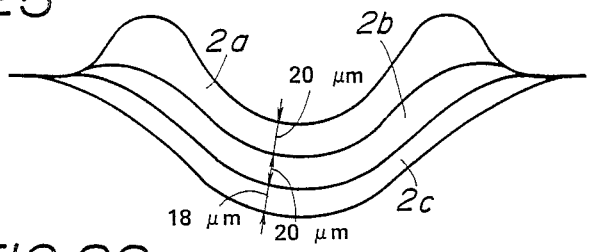
FIG. 25 is a section showing the composition of the section of the metal sheet where the uneven dulled section is formed during a laser dulling process.
Figure 26:
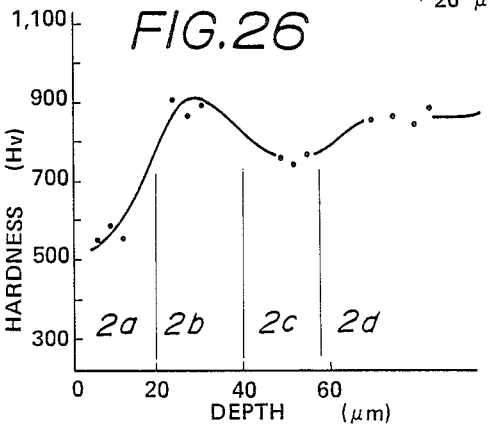
FIG. 26 is a graph showing hardness at respective composing sections of FIG. 25.

FIG. 25 shows an axial section of the uneven formed in the foregoing process. As will be seen herefrom, three surface layers 2a, 2b and 2c are formed on the base metal 2d. The first and the outermost layer 2a was molten and resolidified layer composed of a mixture of austenite and martensite. The thickness of the first layer 2a was 20 μm. The second and intermediate layer 2b was a rehardened layer composed of a mixture of martensite and ϵ carbide. The second layer 2b also has a thickness of 20 μm. The third and innermost layer 2c was a tempered layer composed of a mixture of martensite and carbide. The thickness of the third layer 2c was 18 μm. Hardness of respective first, second and third layers 2a, 2b and 2c are as shown in FIG. 26. The resultant work roll has surface roughness Ra of 2 μm and Rz of 23 μm.

In order to compare with the aforementioned work roll according to the invention, a comparative example of work roll is prepared by the conventional shot blast work. This conventional work roll had a surface roughness Ra of 2 μm and Rz of 25 μm.

Utilizing these inventive work roll and the conventional work roll, experimental rolling operation was performed for temper rolling of a low carbon killed steel which has a thickness of 0.8 mm and was annealed after cold rolling. Temper rolling is performed for draft of 0.8%. After temper rolling, the surface profile of the resultant metal sheet was:

$$Sm/D \approx 1.4$$

$$Sm-D=70\ \mu m$$

Figure 27:
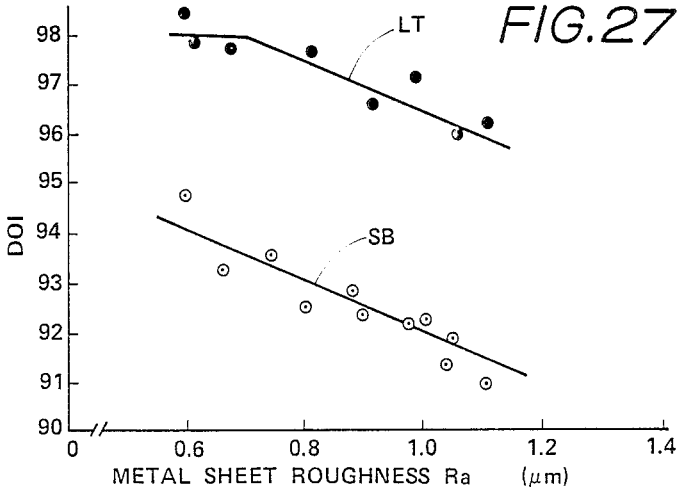
FIG. 27 is a graph showing the center line average roughness and the DIO value in metal sheets, one of which is rolled by means of the preferred embodiment of the work roll and the other is rolled by a conventional work roll dulled by a short blasting process.

After temper rolling, chemical conversion treatment with phorphate system agent is performed on the metal sheet. Thereafter, three-layer coating was performed. The three-layer coating was performed to form the layers with the following thickness:

under-coat: 18 to 20 μm in thickness
intermediate-coat: 30 to 35 μm in thickness
surface-coat: 30 to 35 μm in thickness After coating, DOI value was measured by means of the Dorigon meter. The results of measurement are shown in FIG. 27. In the graph of FIG. 27, the line labeled "LT" represents variation of the DOI value relative to variation of the surface roughness Ra of the metal sheet which was temper rolled by means of the work roll dulled by means of the laser beam. On the other hand, the line labeled "SB" represents variation of the DOI value relative to variation of the surface roughness Ra of the metal sheet temper rolled by means of the work roll dulled by way of shot blast. From FIG. 27, it should be appreciated that the DOI value of the coat surface on the metal sheet temper rolled by means of the inventive work roll is greater than that of the coat on the metal sheet temper rolled by means of the comparative shot blasted work roll in a value 4 to 5.

Figure 28:
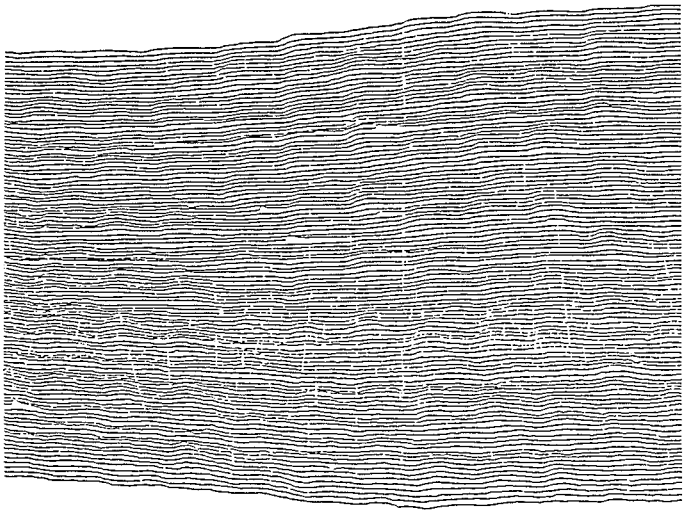
FIG. 28 is a three dimensional roughness chart of a paint coat layer formed on the metal sheet temper rolled by means of the preferred embodiment of the work roll.
Figure 29:
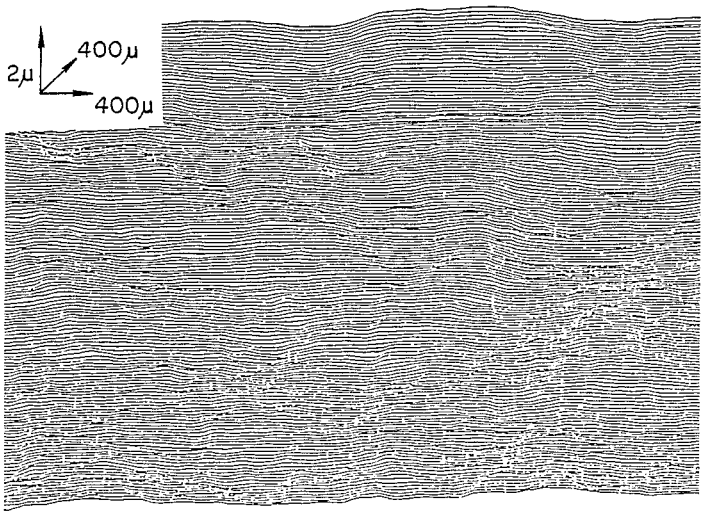
FIG. 29 is a three dimensional roughness chart of a paint coat layer formed on the metal sheet temper rolled by means of a conventional work roll.
Figure 30:
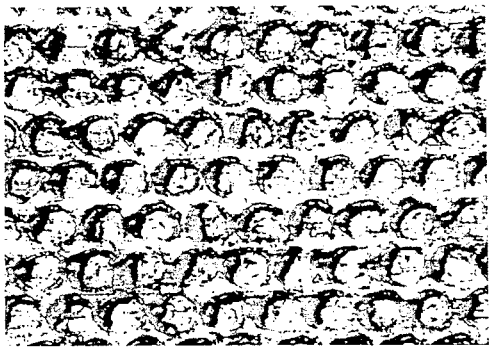
FIG. 30 is a microphotograph of the surface of a metal sheet temper rolled by means of the preferred embodiment of the work roll.
Figure 31:
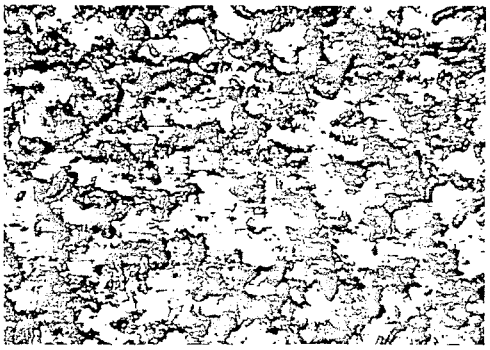
FIG. 31 is a microphotograph of the surface of a metal sheet temper rolled by means of a conventional work roll dulled by a shot blasting process.
Figure 32:
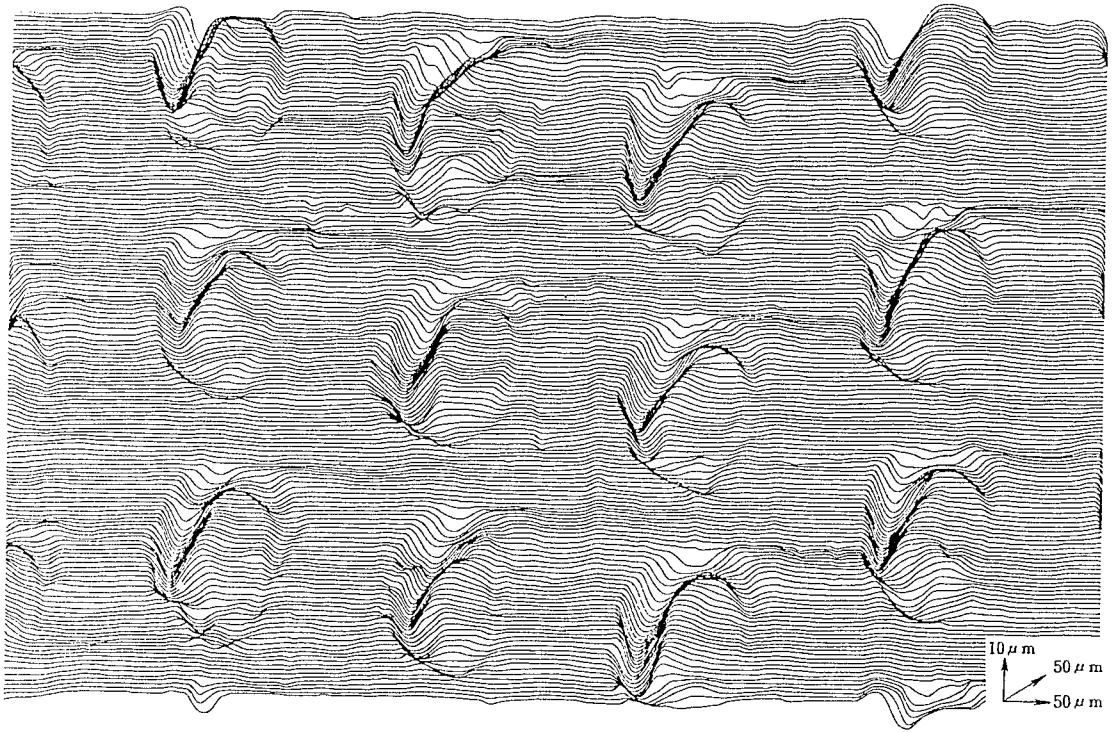
FIG. 32 is a chart showing an enlarged perspective view of the profile of the work roll dulled by means of the laser beam.

FIGS. 28 and 29 are three-dimensional chart showing the roughness of the surface coat layer on the metal sheets set forth above. FIG. 28 shows the coat layer on the metal sheet temper rolled by means of the laser beam dulled work roll of the preferred embodiment, and FIG. 29 shows the coat layer on the metal sheet temper rolled by means of the conventional shot blasted work roll. As will be clear in comparing FIGS. 28 and 29, the coat layer of FIG. 28 is much smoother than that of FIG. 29. The surface condition of the metal sheets before painting are shown in FIGS. 30 and 31. As will be appreciated, FIG. 30 is a microphotograph showing the surface of the metal sheet dulled by means of the preferred embodiment of the work roll, and FIG. 31 is a microphotograph showing the surface of the metal sheet dulled by means of the conventional shot blasted work roll. As clear from FIGS. 30 and 31, the metal sheet of FIG. 30 has regularly and geometrically arranged pattern of uneven dulled section, whereas FIG. 31 shows irregular uneven dulled section on the metal sheet surface. FIG. 32 is a three-dimensional chart showing the surface condition of the metal sheet of FIG. 30 in further enlarged scale.

Press test is additionally performed with respect to the metal sheets set forth above. Baking was observed during pressing of the metal sheet dulled by means of the conventional shot blasted work roll. While, no baking could observed in press forming operation for the metal sheet temper rolled by means of the preferred embodiment of the laser beam dulled work roll.

EXAMPLE 2

Figure 33:
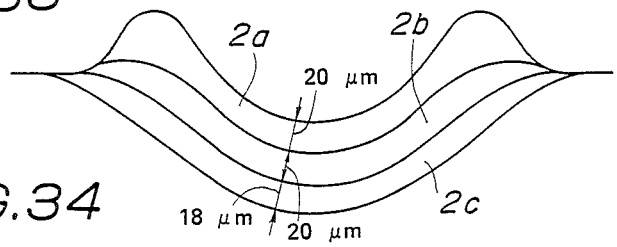
FIG. 33 is an explanatory section showing the thicknesses of mutally distinct compositions of layers in the uneven dulled section formed by subzero treatment after laser beam dulling and temper treatment.
Figure 34:
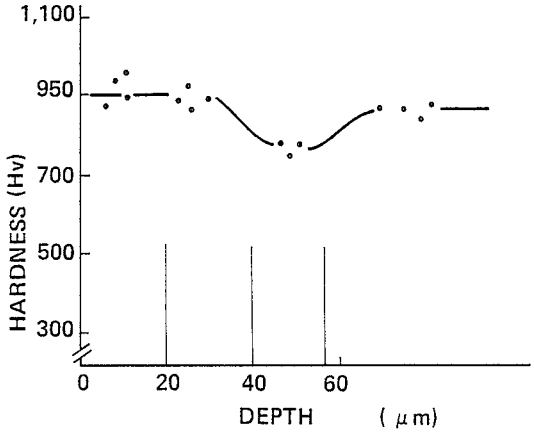
FIG. 34 shows hardnesses of respective layers of FIG. 33.

The laser beam dulled work roll prepared substantially the same manner as the foregoing Example 1 is processed by way of subzero treatment. The subzero treatment is performed by dipping the laser beam dulled work roll into a liquid state nitrogen. The cut section of the uneven dulled section on the work roll after subzero treatment is shown in FIG. 33. As seen from FIG. 33, the surface portion of the uneven dulled section 1 is constituted by three surface layers 2*a*, 2*b* and 2*c* are formed on the base metal 2*d*. The first and the outermost layer 2*a* was hardened layer composed of a martensite converted from molten and resolidified layer composed of a mixture of austenite and martensite of the foregoing Example 1. The thickness of the first layer 2*a* was 20 μm. The second and intermediate layer 2*b* was a rehardened layer composed of a mixture of martensite and ε carbide. The second layer 2*b* also has a thickness of 20 μm. The third and innermost layer 2*c* was a tempered layer composed of a mixture of martensitte and carbide. The thickness of the third layer 2*c* was 18 m. Hardness of respective first, second and third layers 2*a*, 2*b* and 2*c* are as shown in FIG. 34. The resultant work roll has surface roughness Ra of 2 μm and Rz of 23 μm.

Similarly to the foregoing first embodiment, a comparative example of work roll was prepared by the conventional shot blast work. This conventional work roll had a surface roughness Ra of 2 μm and Rz of 25 μm.

Utilizing these inventive work roll and the conventional work roll, experimental rolling operation was performed for temper rolling of a low carbon killed steel which has a thickness of 0.8 mm and was annealed after cold rolling. Temper rolling is performed for draft of 0.8%. After temper rolling, the surface profile of the resultant metal sheet was:

$Sm/D \approx 1.4$ $Sm-D=70\ \mu m$

Figure 35:
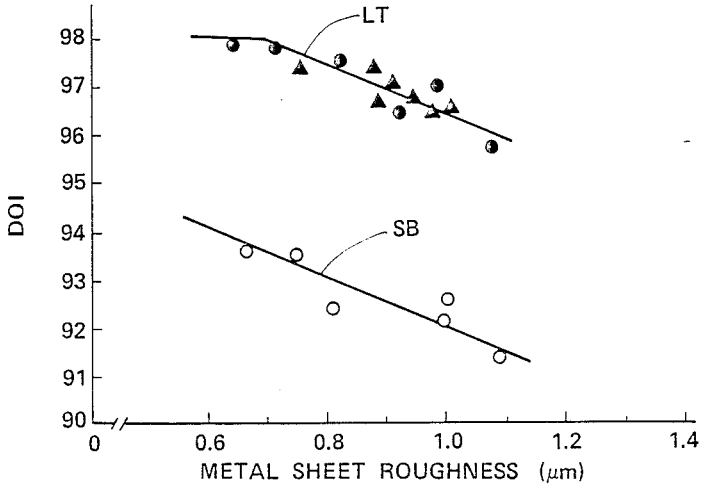
FIG. 35 is a graph showing the center line average roughness Ra and the DIO value in painted metal sheets, one of which material metal sheet has a structure as illustrated in FIG. 33 and the other of which was temper rolled by means of shot blasting a conventional work roll.

After temper rolling, chemical conversion treatment with phorphate system agent is performed on the metal sheet. Thereafter, three-layer coating was performed. The three-layer coating was performed to form the layers with the following thickness:

under-coat: 18 to 20 μm in thickness
intermediate-coat: 30 to 35 μm in thickness
surface-coat: 30 to 35 μm in thickness After coating, DOI value was measured by means of the Dorigon meter. The results of measurement are shown in FIG. 35. In the graph of FIG. 35, the line labeled "LT" represents variation of the DOI value relative to variation of the surface roughness Ra of the metal sheet which was temper rolled by means of the work roll dulled by means of the laser beam. On the other hand, the line labeled "SB" represents variation of the DOI value relative to variation of the surface roughness Ra of the metal sheet temper rolled by means of the work roll dulled by way of shot blast. From FIG. 35, it should be appreciated that the DOI value of the coat surface on the metal sheet temper rolled by means of the inventive work roll is greater than that of the coat on the metal sheet temper rolled by means of the comparative shot blasted work roll in a value 4 to 5.

Figure 36:
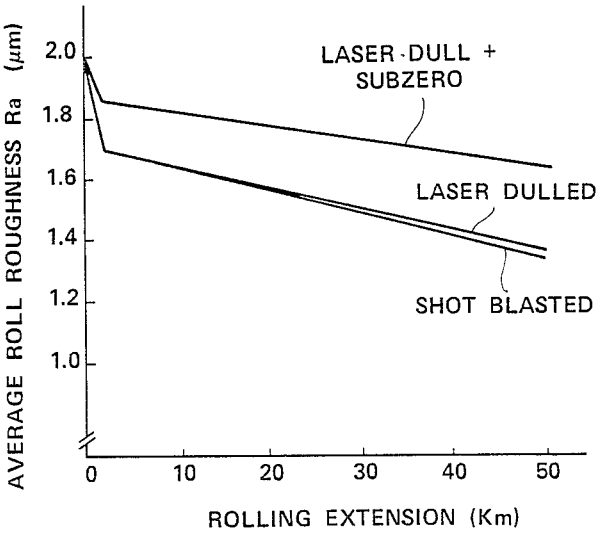
FIG. 36 is a graph showing the lowering of the roughness on the work rolls one of which is subjected to subzero treatment after the laser beam dulling process, another of which was subjected to a laser beam dulling process and the other subjected to shot blasting.
Figure 37:
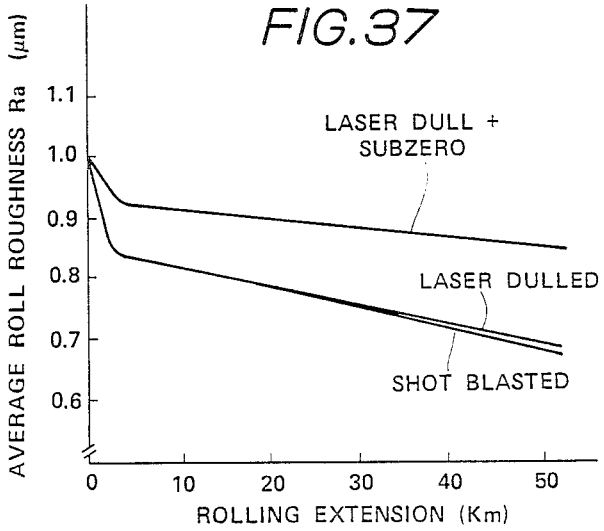
FIG. 37 is a graph showing lowering of roughness on metal sheets which are respectively temper rolled by means of work rolls one of which is subjected to subzero treatment after a laser beam dulling process, another subjected to laser beam dulling process and the other subjected to shot blasting.

In addition, utilizing the aforementioned work rolls, lowering of roughness Ra of the uneven dulled sections on the work roll and the metal sheet during temper rolling was monitored. The variation of the roughness Ra on the work roll and the metal sheet as expanding the rolling length is shown in FIGS. 36 and 37. The extension of the rolling length is derived based on the number of rotation of the work roll. At this time, the diameter of the work roll is set at 560 mm in diameter. As will be observed from FIGS. 36 and 37, the ratio of roughness drops on the work roll which is laser beam dulled but is not subject to subzero treatment and the shot blasted work roll are essentially the same rate. In roughness drops for the aforementioned laser beam dulled but not being subzero treated work roll and the shot blasted work roll are significant at the initial stage of temper rolling. In comparison with these, roughness drop in the subzero treated work roll was not so significant even at the initial stage of the temper rolling. Furthermore, the subzero treated work roll lowest the roughness at substantially smaller rate than that of other two work rolls throughout the overall length of rolling process.

EXAMPLE 3

The preferred embodiment of the laser beam dulled work roll as set forth with respect to the Examples 1 and 2, is further subject plating. Namely, the preferred embodiment of the laser beam dulled work roll is, at first, subject subzero treatment by means of the liquid state nitrogen. The subzero treated work roll is processed for forming surface hardening layer by way of plating. Plating is performed by chromium plating. The thickness of the chromium plating layer and condition of plating are as follows.

As a plating bath, a surgent bath ($CrO_3$: 200 g/l, $H_2SO_4$: 2 g/l) is used. Plating is performed by static plating at a temperature of the bath at 50° C., electric current intensity of 30 $A/dm^2$.

thickness of the plated chromium coat layer was 0.8 μm.

Figure 38:
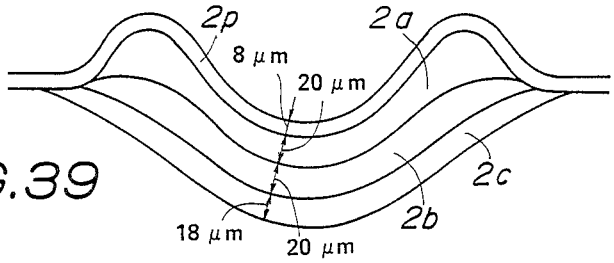
FIG. 38 is an explanatory section showing another example of thickness of mutually distinct compositions of layers in the uneven dulled section formed by subzero treatment after laser beam dulling and temper treatment.
Figure 39:
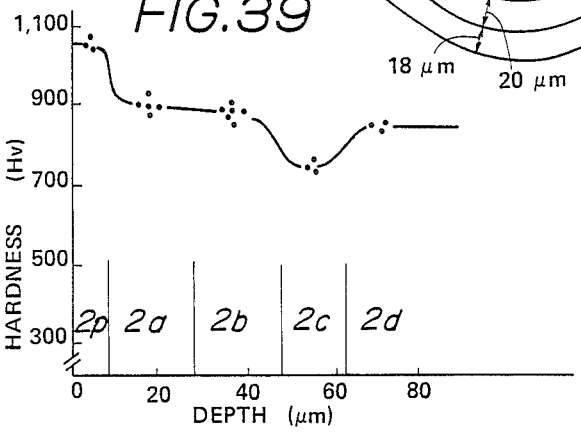
FIG. 39 shows hardness of respective layers of FIG. 38.

The cut section of the uneven dulled section on the work roll after subzero treatment is shown in FIG. 38. As seen from FIG. 38, the surface portion of the uneven dulled section 1 is constituted by four surface layers 2p, 2a, 2b and 2c are formed on the base metal 2d. An surface layer 2p is a Cr plating layer of 0.8 μm in thickness. The first and the outermost layer 2a was hardened layer composed of a martensite converted from molten and resolidified layer composed of a mixture of austenite and martensite of the foregoing Example 1. The thickness of the first layer 2a was 20 μm. The second and intermediate layer 2b was a rehardened layer composed of a mixture of martensite and ε carbide. The second layer 2b also has a thickness of 20 μm. The third and innermost layer 2c was a tempered layer composed of a mixture of martensite and carbide. The thickness of the third layer 2c was 18 μm. Hardness of respective surface layer and first, second and third layers 2p, 2a, 2b and 2c are as shown in FIG. 38. The resultant work roll has surface roughness Ra of 2 μm and Rz of 23 μm.

Similarly to the foregoing first embodiment, a comparative example of work rolls were provided. On the of the comparative work roll was that used in the foregoing Example 2, i.e. the work roll which was dulled by means of laser beam and thereafter subject the subzero treatment, but is not coated by the Cr plating coat layer. This work roll has surface roughness Ra of 2 μm and Rz 23 μm. The other comparative work roll was prepared by the conventional shot blast work. This conventional work roll had a surface roughness Ra of 2 μm and Rz of 25 μm.

Utilizing these inventive work roll and the conventional work roll, experimental rolling operation was performed for temper rolling of a low carbon killed steel which has a thickness of 0.8 mm and was annealed after cold rolling. Temper rolling is performed for draft of 0.8%. After temper rolling, the surface profile of the resultant metal sheet was:

$$Sm/D \approx 1.4$$

$$Sm-D=70\ \mu m$$

After temper rolling, chemical conversion treatment with phorphate system agent is performed on the metal sheet. Thereafter, three-layer coating was performed. The three-layer coating was performed to form the layers with the following thickness:

under-coat: 18 to 20 μm in thickness
intermediate-coat: 30 to 35 μm in thickness
surface-coat: 30 to 35 μm in thickness In the painting process, sanding has not been performed at respective steps.

Figure 40:
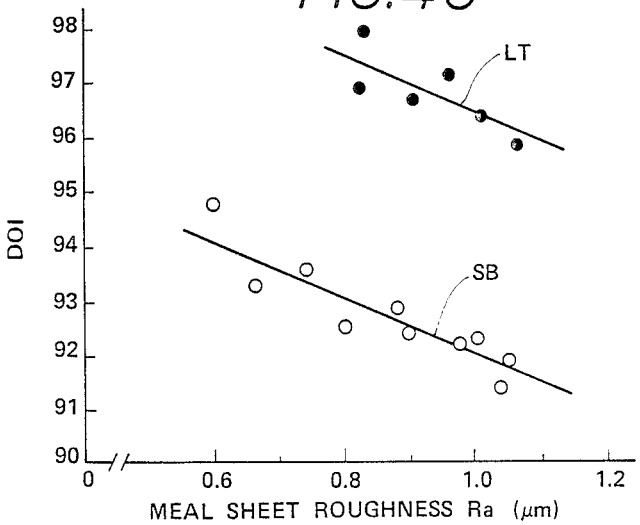
FIG. 40 is a graph showing the center line average roughness Ra and the DIO value in the painted metal sheets, one of which material metal sheet has a structure as illustrated in FIG. 38 and the other is temper rolled by means of shot blasted conventional work roll.

After coating, DOI value was measured by means of the Dorigon meter. The results of measurement are shown in FIG. 40. In the graph of FIG. 40, the line labeled "LT" represents variation of the DOI value relative to variation of the surface roughness Ra of the metal sheet which was temper rolled by means of the work roll dulled by means of the laser beam. On the other hand, the line labeled "SB" represents variation of the DOI value relative to variation of the surface roughness Ra of the metal sheet temper rolled by means of the work roll dulled by way of shot blast. From FIG. 40, it should be appreciated that the DOI value of the coat surface on the metal sheet temper rolled by means of the inventive work roll is greater than that of the coat on the metal sheet temper rolled by means of the comparative shot blasted work roll in a value 4 to 5.

Figure 41:
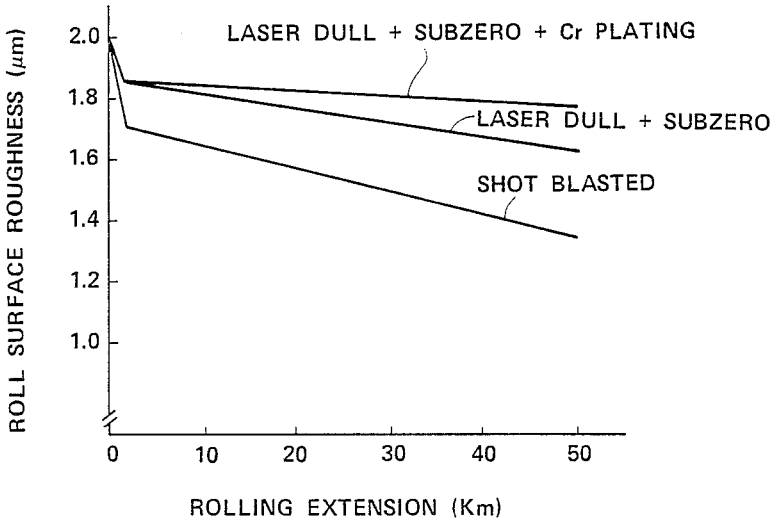
FIG. 41 is a graph showing lowering of roughness on the work rolls one of which is subjected to subzero treatment after a laser beam dulling process, another subjected to a laser beam dulling process and the other subjected to shot blasting.
Figure 42:
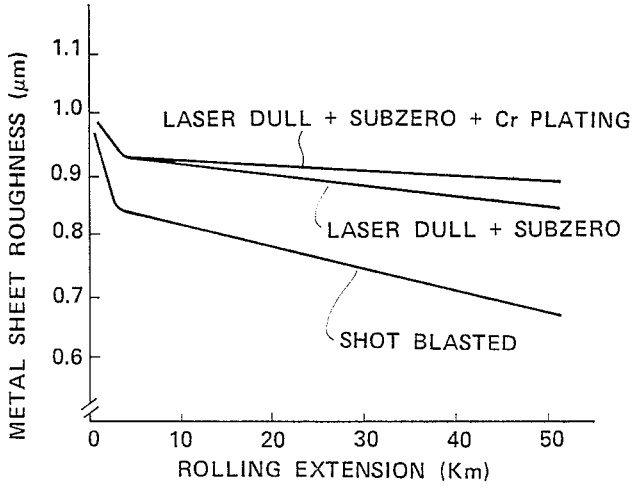
FIG. 42 is graph showing lowering of roughness on the metal sheets which are respectively temper rolled by means of work rolls one of which is subjected to a subzero treatment after laser beam dulling process, another subjected to a laser beam dulling process and the other subjected to shot blasting.

In addition, utilizing the aforementioned work rolls, lowering of roughness Ra of the uneven dulled sections on the work roll and the metal sheet during temper rolling was monitored. The variation of the roughness Ra on the work roll nd the metal sheet as expanding the rolling length is shown in FIGS. 41 and 42. The extension of the rolling length is derived based on the number of rotation of the work roll. At this time, the diameter of the work roll is set at 560 mm in diameter. As will be observed from FIGS. 41 and 42, the ratio of roughness drop on the shot blasted work roll is significant at the initial stage of temper rolling, as set forth in the foregoing Example 2. In comparison withe these, roughness drop in the subzero treated work roll was not so significant even at the initial stage of the temper rolling. Furthermore, the subzero treated work roll lowest the roughness at substantially smaller rate than that of other two work rolls throughout the overall length of rolling process. However, the subzero treated work roll has higher roughness drop rate than that of the Cr plating coated work roll as will be clear from FIGS. 41 and 42.

EXAMPLE 4

The fourth example is directed to employ a work roll of 70 mmϕ and a back-up roll of 140 mmϕ. The rolls are set in a small-size four high mill. The work roll to be employed in this example is prepared according to the present invention and has the following composition:

C: 0.85 Wt%
Si: 0.8 Wt%
Mn: 0.4 Wt%
Ni: 0.15 Wt%
Cr: 2.9 Wt%
Mo: 0.29 Wt%
V: 0.01 Wt%

This composition of the work roll is usual composition of the material for forming work roll for rolling. As a laser beam, pulsatile $CO_2$ gas laser beam is used. The laser beam is irradiated onto the roll surface for performing dulling operation at a predetermined roughness in the following irradiation condition:

laser energy: 2 kW
energy density: $6.4\times10^6$ W/cm$^2$
irradiation period: 50 μsec/pulse By irradiating the laser beam in the above-mentioned condition, the uneven dulled sections 1 are formed on the surface of the work roll 3. The uneven dulled sections 1 formed on the work roll surface are patterned as follow:

pitch of uneven dulled sections: 250 μm in both circumferential and axial directions:
diameter of the uneven: 180 μm $$Sm/D \approx 1.4$$

$$Sm-D=70\ \mu m$$

The resultant work roll has surface roughness Ra of 2.1 μm and Rz of 26 μm. This work roll 3 depressed to the back-up roll to kiss at a hertz pressure 35 Kgf/mm$^2$. The work roll is then driven at 20 r.p.m. for 3 min. for normalization. After normalization, the surface roughness Ra and Rz are lowered respectively to 2.0 μm and 23 μm. At this time, the contact area of one annular crest 2 to contact with the back-up roll was 0.0026 mm$^2$.

Figure 43:
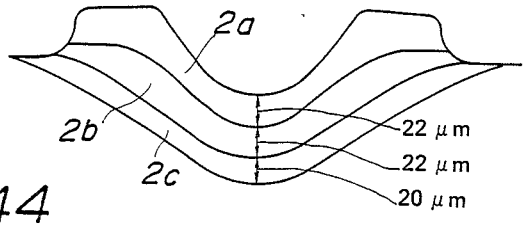
FIG. 43 is an explanatory section showing thickness of mutually distinct compositions of layers in the uneven dulled section formed by subzero treatment after laser beam dulling and tempering treatment.
Figure 44:
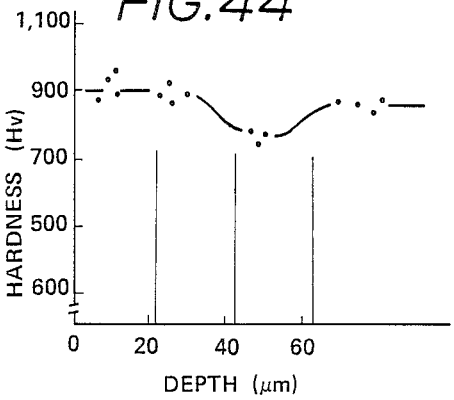
FIG. 44 shows hardness of respective layer of FIG. 43.

FIG. 43 shows an axial section of the uneven product formed in the foregoing process. As will be seen herefrom, three surface layers 2*a*, 2*b* and 2*c* are formed on the base metal 2*d*. The first and the outermost layer 2*a* was molten and resolidified layer composed of a mixture of austenite and martensite. the thickness of the first layer 2*a* was 22 μm. The second and intermediate layer 2*b* was a rehardened layer composed of a mixture of martensite and ε carbide. The second layer 2*b* also has a thickness of 22 μm. The third and innermost layer 2*c* was a tempered layer composed of a mixture of martensite and carbide. The thickness of the third layer 2*c* was 20 μm. Hardness of respective first, second and third layers 2*a*, 2*b* and 2*c* are as shown in FIG. 44. The resultant work roll had a surface roughness Ra of 2 μm and Rz of 23 μm.

In order to compare with the aforementioned work roll according to the invention, a comparative example of work roll is prepared by the conventional shot blast work. This conventional work roll had a surface roughness Ra of 2 μm and Rz of 25 μm. In addition, the work roll dulled by means of the laser beam but not performed the normalization was provided as a comparative sample.

Utilizing these inventive work roll and the conventional work roll, experimental rolling operation was performed for temper rolling of a low carbon killed steel which has a thickness of 0.8 mm and was annealed after cold rolling. Temper rolling is performed for draft of 0.8%. After temper rolling, the surface profile of the resultant metal sheet was:

$$Sm/D \approx 1.3$$

$$Sm - D = 60\ \mu m$$

Figure 45:
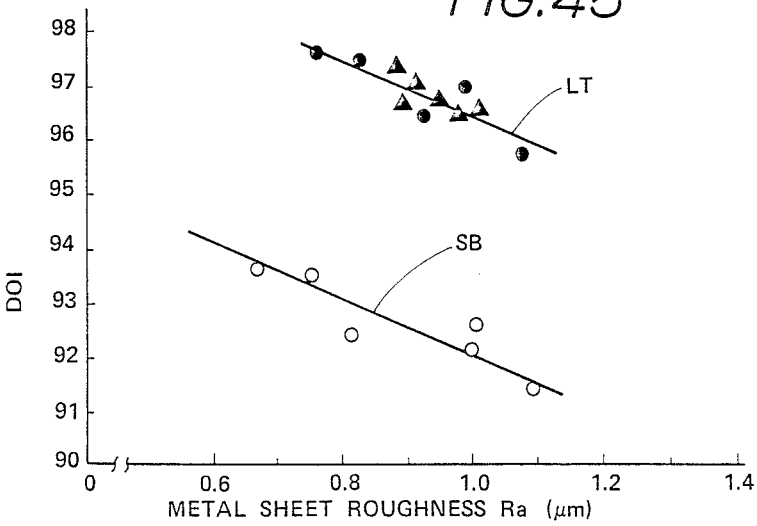
FIG. 45 is a graph showing the center line average roughness Ra and the DIO value in the painted metal sheets, one of which material metal sheet has a structure as illustrated in FIG. 43 and the other of which is temper rolled by means of a shot blasted conventional work roll.
Figure 46:
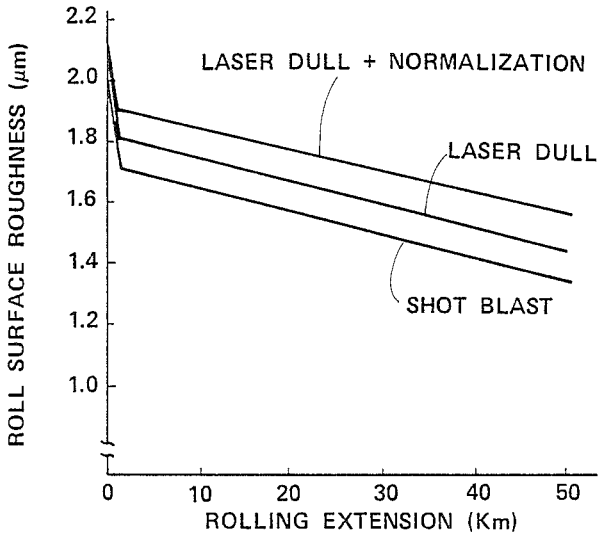
FIGS. 46 and 47 are graphs showing lowering of roughness on the work roll and rolled metal sheet according to expansion of the length of rolling on the work roll to which surface temper treatment is performed after a dulling process by means of the laser beam, a work roll dulled by a laser beam, and a work roll dulled by conventional shot blasting.
Figure 47:
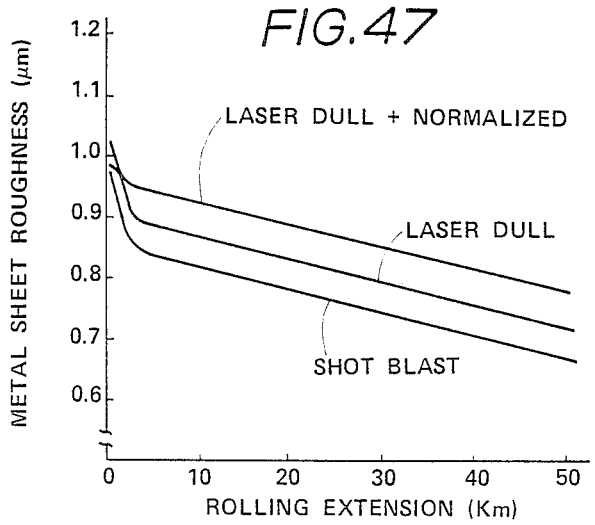

After temper rolling, chemical conversion treatment with phorphate system agent is performed on the metal sheet. Thereafter, three-layer coating was performed. The three-layer coating was performed to form the layers with the following thickness:

under-coat: 18 to 20 μm in thickness
intermediate-coat: 30 to 35 μm in thickness
surface-coat: 30 to 35 μm in thickness After coating, the DOI value was measured by means of the Dorigon meter. The results of measurement are shown in FIG. 45. In the graph of FIG. 45, the line labeled "LT" represents variation of the DOI value relative to variation of the surface roughness Ra of the metal sheet which was temper rolled by means of the work roll dulled by means of the laser beam. On the other hand, the line labeled "SB" represents variation of the DOI value relative to variation of the surface roughness Ra of the metal sheet temper rolled by means of the work roll dulled by way of shot blast. From FIG. 45, it should be appreciated that the DOI value of the coat surface on the metal sheet temper rolled by means of the inventive work roll is greater than that of the coat on the metal sheet temper rolled by means of the comparative shot blasted work roll in a value 4 to 5.

In the temper rolling process, the hertz pressure between the work roll and the back-up roll was 40 Kgf/mm$^2$. At this time, the actually applied pressure to the unit area of the annular crest 2 of the work roll was 500 Kgf/mm$^2$.

Press test is additionally performed with respect to the metal sheets set forth above. Baking was observed during pressing of the metal sheet dulled by means of the conventional shot blasted work roll. While, no baking could observed in the press forming operation for the metal sheet temper rolled by means of the preferred embodiment of the laser beam dulled work roll.

EXAMPLE 5

Similarly to the foregoing Example 4, the normalization treatment for the work roll which was dulled by means of the laser beam, was performed. before normalization, the roughness Ra and Rz on the surface of the work roll were respectively 2.1 μm and 26 μm. This work roll is kissed onto the back-up roll in a hertz pressure of 33 Kgf/mm$^2$. The rolls are driven at a speed 20 r.p.m. for 3 min. After normalization, the roughness Ra and Rz are lowered respectively to 2.0 μm and 23 μm. At this time, the contact area of each uneven dulled section was 0.0018 mm$^2$.

The work roll thus normalized was subjected to subzero treatment for hardening the surface layer. Similarly to the foregoing examples, subzero treatment was performed by dipping the roll into liquid nitrogen. Cut section of thus prepared work roll surface section was similar to that shown in FIG. 43. However, in this case, the first outermost layer was composed of martensite as converted during subzero treatment.

Similarly to the foregoing first examples, a comparative example of work roll was prepared by the conventional shot blast work. This conventional work roll had a surface roughness Ra of 2 μm and Rz of 25 μm.

Utilizing the inventive work roll and the conventional work roll, an experimental rolling operation was performed for temper rolling of a low carbon killed steel which had a thickness of 0.8 mm and was annealed after cold rolling. Temper rolling was performed for draft of 0.8%. After temper rolling, the surface profile of the resultant metal sheet was:

$$Sm/D \approx 1.3$$

$$Sm - D = 60\ \mu m$$

After temper rolling, a chemical conversion treatment with a phorphate system agent was performed on the metal sheet. Thereafter, three-layer coating was performed. The three-layer coating was performed to form the layers with the following thickness:

under-coat: 18 to 20 μm in thickness
intermediate-coat: 30 to 35 μm in thickness
surface-coat: 30 to 35 μm in thickness After coating, DOI value was measured by means of the Dorigon meter. Similarly to the foregoing examples, the DOI value of the coat surface on the metal sheet temper rolled by means of the inventive work roll is greater than that of the coat on the metal sheet temper rolled by means of the comparative shot blasted work roll in a value 4 to 5.

Figure 48:
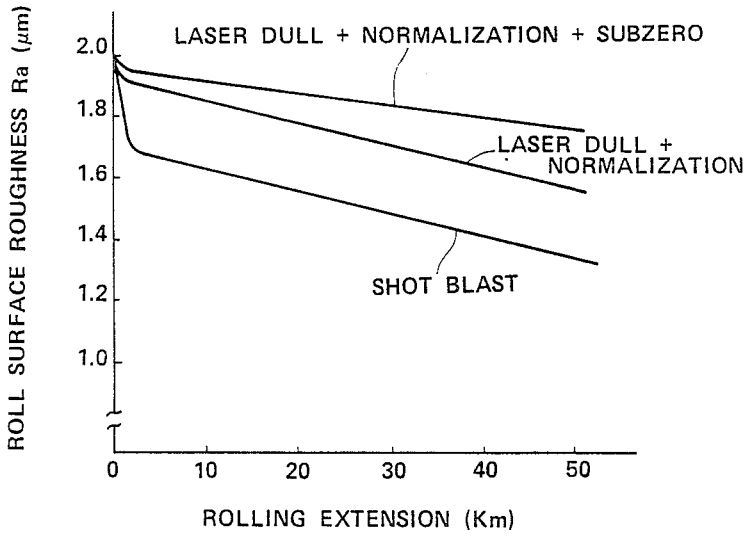
FIG. 48 is a graph showing lowering of roughness on the work rolls one of which is subject to subzero treatment after a laser beam dulling process, another subjected to laser beam dulling process and the other subjected to shot blasting.
Figure 49:
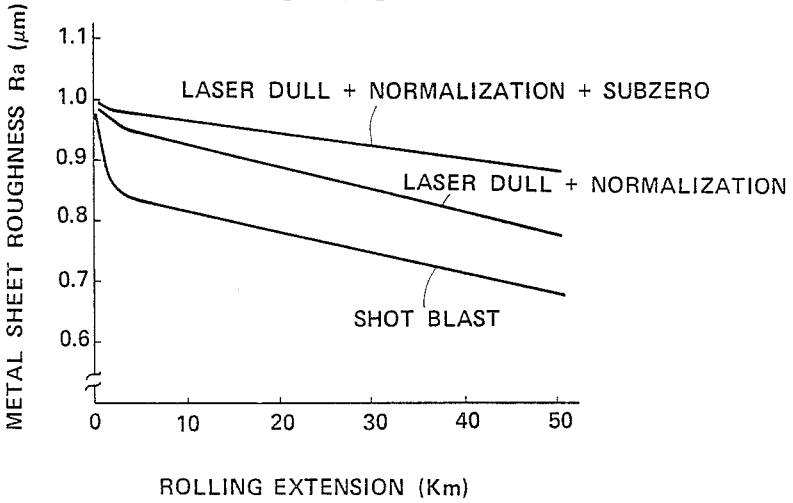
FIG. 49 is a graph showing lowering of roughness on the metal sheets which are respectively temper rolled by means of work rolls one of which is subjected to a subzero treatment after a laser beam dulling process, another subjected to a laser beam dulling process and the other subjected to shot blasting.
Figure 50:
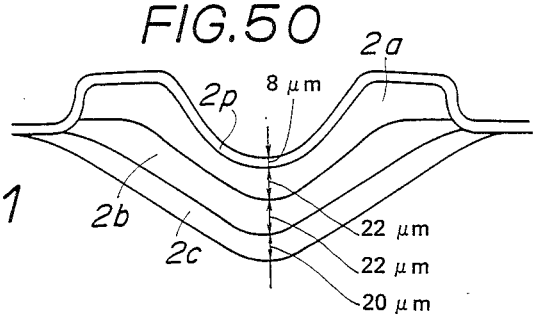
FIG. 50 is an explanatory section showing another example of thickness of mutually distinct compositions of layers in the uneven dulled section formed by subzero treatment after laser beam dulling and temper treatment.
Figure 51:
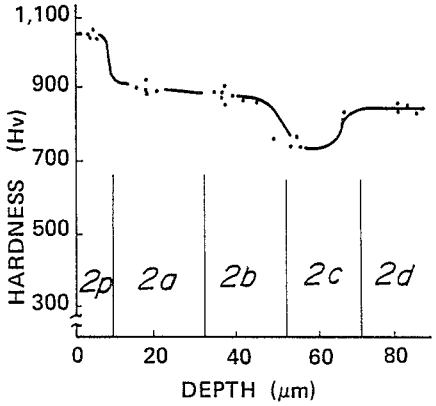
FIG. 51 shows hardness of respective layers of FIG. 50.
Figure 52:
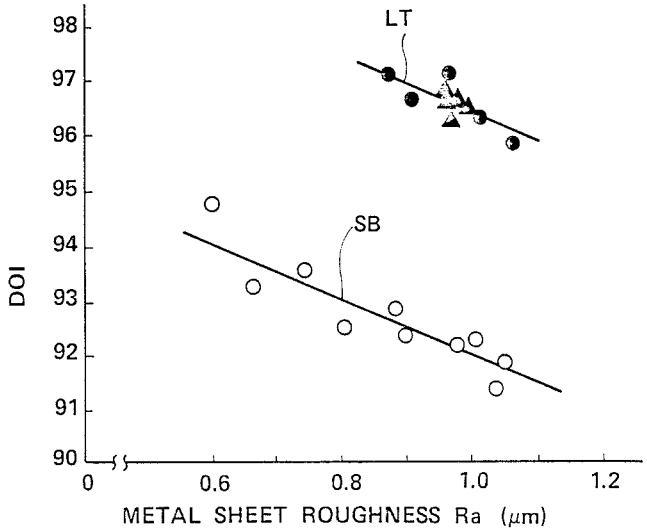
FIG. 52 is a graph showing the center line average roughness Ra and the DIO value in the painted metal sheets, one of which material metal sheet has a structure as illustrated in FIG. 50 and the other is temper rolled by means of a shot blasted conventional work roll.
Figure 53:
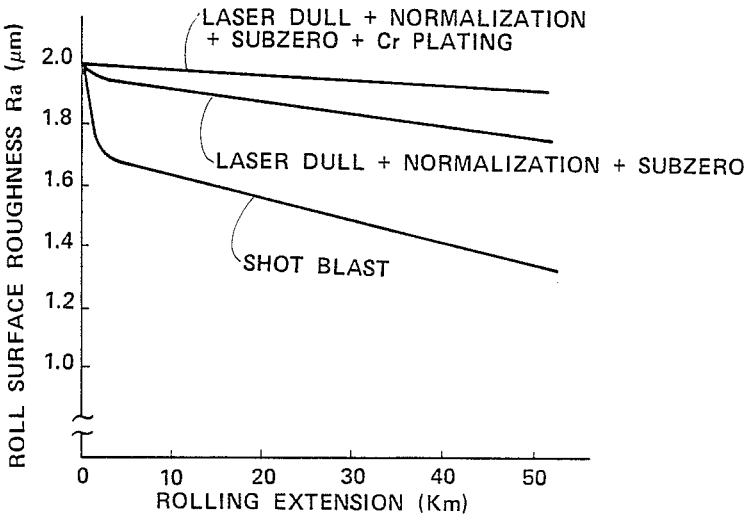
FIG. 53 is graph showing lowering of roughness on the work rolls one of which is subject to subzero treatment after a laser beam dulling process, another subjected to a laser beam dulling process and the other subjected to shot blasting.
Figure 54:
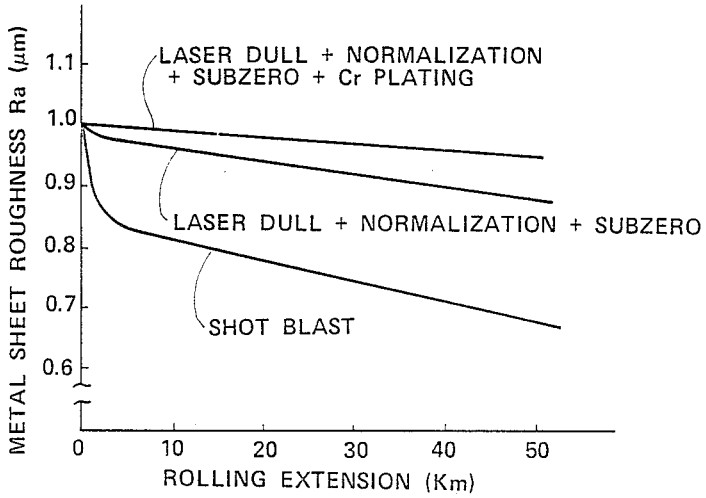
FIG. 54 is a graph showing lowering of roughness on the metal sheets which are respectively temper rolled by means of work rolls one of which is subjected to a subzero treatment after a laser beam dulling process, another subjected to a laser beam dulling process and the other subjected to shot blasting.

On the other hand,

In addition, utilizing the aforementioned work rolls, lowering of roughness Ra of the uneven dulled sections on the work roll and the metal sheet during temper rolling with hertz pressure of 40 Kgf/mm$^2$ was monitored. The variation of the roughness Ra on the work roll and the metal sheet as expanding the rolling length is shown in FIGS. 48 and 49. The extension of the rolling length is derived based on the number of rotation of the work roll. At this time, the diameter of the work roll is set at 560 mm in diameter. On the other hand, in the work roll laser beam dulled, normalized and subzero treated was applied the actual pressure at 800 Kgf/mm$^2$. As will be observed from FIGS. 48 and 49, the ratio of roughness drop on the shot blasted work roll is significant at the initial stage of temper rolling, as set forth in the foregoing example 2. In comparison withe these, roughness drop in the subzero treated work roll was not so significant even at the initial stage of the temper rolling. Furthermore, the surface normalized work roll lowers the roughness at substantially smaller rate than that of the shot blasted roll. However, the normalized work roll has a higher roughness drop rate than that of the normalized and subzero tread work roll as will be clear from FIGS. 48 and 49.

Experimentation is further performed by performing Cr plating on the surface of the work roll which was dulled by means of the laser beam, normalized after dulling operation and subzero treated thereafter. The cut section of the uneven, product, the hardness of respective layers, roughness Ra of the painted surface of the temper rolled metal sheet, the roughness variations on the work roll surface and the metal sheet surface are shown in FIGS. 50 to 54. As will be seen from these figures, it should be appreciated similar but better DOI value and smaller roughness variation can be obtained by providing the Cr plating coat layer.

Figure 55:
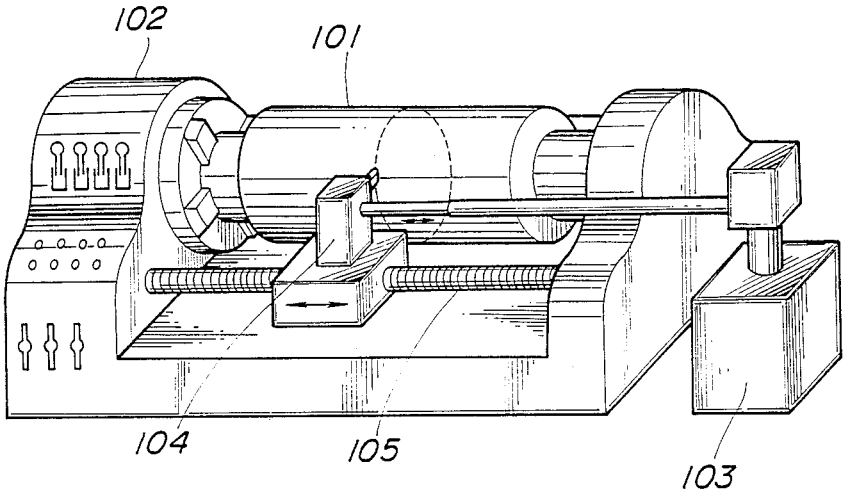
FIG. 55 is a perspective view of the preferred embodiment of an apparatus for performing a laser beam dulling treatment for making the preferred embodiment of the work roll according to the invention.

FIG. 55 shows an apparatus for performing dulling operation for the work roll by means of the laser beam. The work roll dulling apparatus generally has an equivalent construction to lathe, grinder or so forth. The apparatus includes a roll support 102 for rotatably supporting the material roll 101. The roll support 102 is operable to rotatingly drive the material roll 101 at a predetermined rotation speed.

A laser beam generator 103 is provided in the vicinity of the roller support 102. The laser beam generator 103 is connected to a laser head 104 via a telescopically formed beam path tube 104*a*. The laser head 104 opposes to the outer periphery of the material roll and is focused onto a predetermined spot on the roller periphery. The laser head 104 has a base 104*b* engaged with a a spiral rod 105 which extends parallel to the material roll. Therefore, the laser head with the base is driven in a direction parallel to the material roll according to rotation of the spiral rod 105.

The pitch of the uneven dulled sections determining the roughness of the roll surface can be adjusted by adjusting drive speed of the roll support 102 and the spiral rod 105. The depth of the uneven dulled sections can be thus controlled by adjusting circumferential and axial feed speed of the roll and the laser head and as well as the magnitude of the energy of the laser beam.

An assist gas 113, such as oxygen gas, is discharged toward the point 112 on the material roll, to which the laser beam 111 is irradiated via an assist gas nozzle 114. The assist gas discharge nozzle is inclined with respect to the plane lying substantially perpendicular to the axis of the laser beam. In the preferred embodiment, the preferred inclination angle $\theta$ of the assist gas discharge nozzle 114 is in a range of 60° to 90°.

FIGS.

Figure 57:
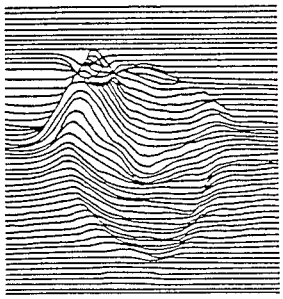
FIGS. 57 and 58 are three-dimensional charts of uneven dulled section formed by a laser beam dulling process.
Figure 58:
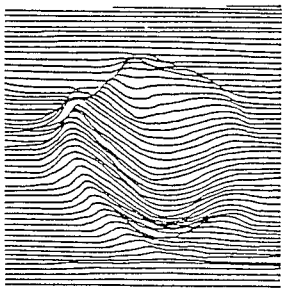

57 and 58 are three-dimensional chart showing the individual uneven dulled section 1 formed by irradiation of the laser beam. As seen from FIGS. 57 and 58 and as explained with respect to the former section which is given for disclosing the work roll per se for temper rolling, each uneven dulled section 1 is constituted by the concave 1*a* and the annular crest 2 extending substantially along the outer circumference of the concave. In the charts of FIGS. 57 and 58, the uneven dulled section 1 of FIG. 57 has higher crest 1*a'* at left side. In this case, the rolling pressure exerted between the back-up roll is received at the higher crest 1*a'*. As a result, wearing of the crest during the temper rolling operation is rather great. On the other hand, in case that substantially even height of the crest 2 is formed in substantially overall circumferential edge of the concave 1*a*, the overall area of the top of the crest receives the rolling pressure. Therefore, the rolling pressure to be exerted at the unit area of the crest becomes smaller to reduce wearing. It is found that when the extension of the even height top of the crest is greater than or equal to 60% of the overall circumferential edge length of the concave, wearing of the crest 2 can be remarkably reduced.

In order to test the performance of the work roll dulled by the apparatus set forth above, an experimentation was performed. The experimentation was performed by utilizing a substantially small-size roll, such as for laboratory use. Therefore, the diameter of the work roll prepared by the aformentioned apparatus was 70 mm. The chemical composition of the material roll was C: 0.85 Wt%
Si: 0.8 Wt%
Mn: 0.4 Wt%
Ni: 0.15 Wt%
Cr: 2.9 Wt%
Mo: 0.29 Wt%
V: 0.01 Wt%

This composition of the work roll is usual composition of the material for forming work roll for rolling. In preparation of the material roll 101, the aforementioned materials are molten and cast. The cast block was subject forging at forging ratio of 3.5 at a temperature of 1100° C. Normalization is then performed shrinking at a temperature of 950° C. carbide spheroidizing treatment was performed at a temperature 800° C. for 10 hours and thereafter at 700° C. for 10 hours. The processed block was machined into a predetermined configuration. After machining, the machined block was heated to 900° C. and put into an oil for hardening treatment and thereafter tempered at a temperature of 650° C. The tempered block was again machined to a final dimension and configuration. Then, the finished roll-shaped block was heated by way of induction heating at a temperature of 900° C. and put into water for hardening. After hardening, low temperature temper treatment was performed at a temperature of 150° C. Finally, surface grinding was performed. After the aforementioned sequence of treatment, the composite structure of the material roll exhibited uniform distribution of spheroidal carbide in martensite base.

In the preferred embodiment of the apparatus, a mechanical chopper is employed in generation of the pulsatating laser beam. As a laser, $CO_2$ gas laser beam was used. Roughing operation was thus performed by means of the dulling apparatus set forth above.

Laser was irradiated in the following conditions:
laser energy: 2 kW
pulse frequency: 56 KHz
energy density: $6.4\times10^6$ W/cm$^2$
irradiation period: 13 μsec/pulse By irradiating the laser beam in the above-mentioned condition, the uneven dulled sections are formed on the surface of the work roll. The uneven dulled sections formed on the work roll surface are patterned as follows:

pitch of unevenesses: 170 μm in both circumferential and axial directions;

The roughness of the obtained roughness $R_{max}$ on the roll surface was about 15 μm. The hardness distribution and composition of layers formed on the surface portion of the roll is shown In FIG. 59.

The roll dulled according to the foregoing process was subjected to the subzero treatment. In the subzero treatment, the roll was driven to rotate at a speed of 10 r.p.m. Against the rotating roll, liquid nitrogen at a temperature −196° C. was discharged. The composition and hardness of each layer around the surface of the roll after the subzero treatment is shown in FIG. 60. As will be appreciated by comparing FIGS. 59 and 60, the first and outermost layer, i.e. a molten and resolidified metal layer, was hardened by the subzero treatment to increase its hardness. This comes from conversion of the austenite in the first layer in the dulled roll into martensite.

Figure 61:
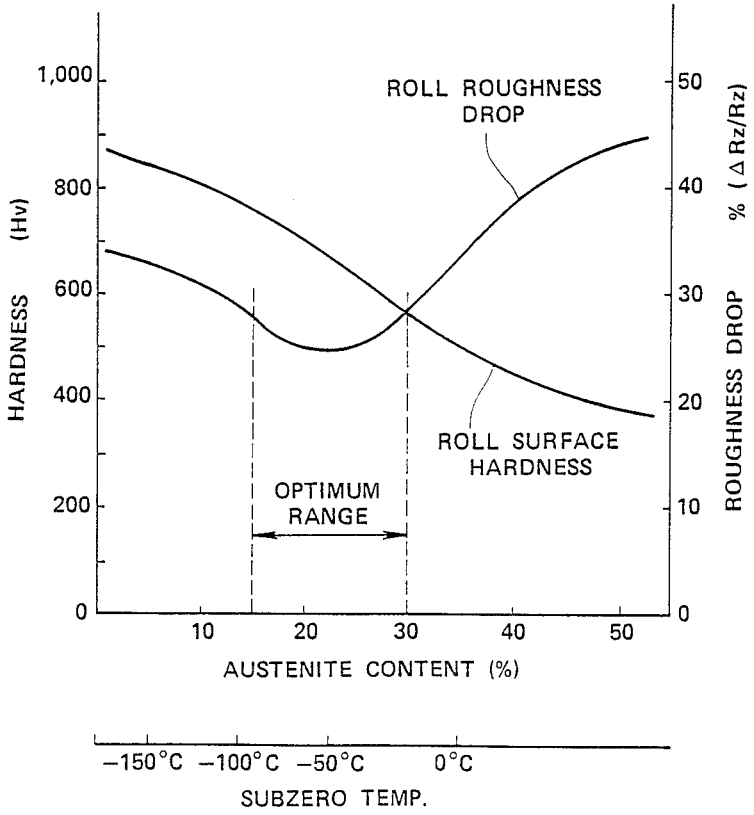
FIG. 61 is a graph showing the amount of austenite, hardness and lowering magnitude of roughness after subzero treatment.

The Japanese Patent First Publication (Tokkai) No. Showa 51-45614, the Japanese Patent First Publication (Tokkai) No. Showa 54-159367 contain a suggestion for subzero treatment for hardening a roll surface after discharge working at substantially low temperature. However, this substantially low temperature subzero treatment causes an increase of brittle of the uneven dulled sections, i.e. crests to lower roughness. It was found that with decreasing of the content of austenite, brittleness increases. Roughness drop in temper rolling of hoop metal in the length of 60 km at a speed of 100 m/min is shown in FIG. 61. As will be seen from FIG. 61, when the content of the austenite is substantially small, the roughness drop is extremely high. On the other hand, when 15% to 30% of austenite was increased, the roughness drop becomes minimum. Therefore, in the preferred process, the subzero treatment is performed to maintain the austenite in a range of content in 15% to 30%.

Figure 62:
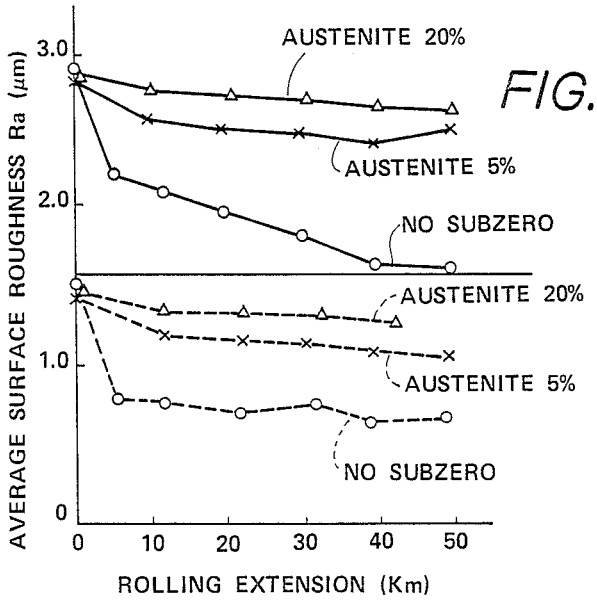
FIG. 62 is a graph showing the relationship between roughness of the roll surface and the rolling length.

FIG. 62 shows variation of the surface roughness in temper rolling of the low carbon Al killed steel which has a thickness of 0.8 mm. For temper rolling the work rolls containing 5% and 20% of austenite in the surface layer were used. As seen from FIG. 62, the roughness drop ratio in the work roll containing 5% of austenite was much higher than that of the work roll containing 20% of austenite.

Figure 63:
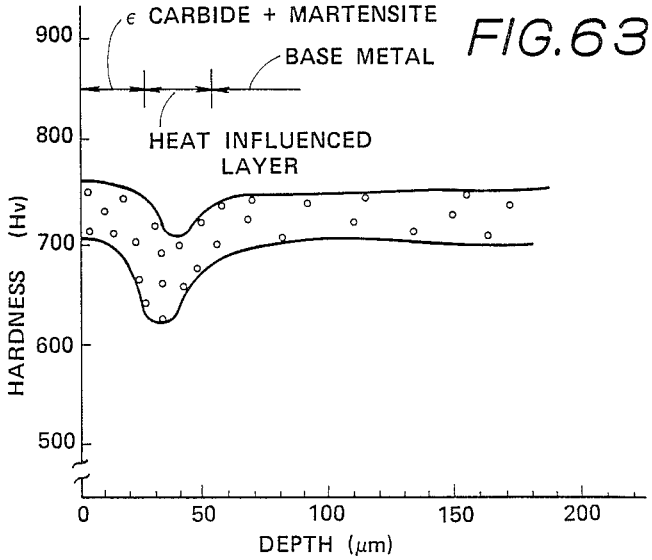
FIG. 63 shows examples of the relationship between the depth and hardness on the surface portion of the work roll.

For the work roll, to which the subzero tretment set forth above was performed, low temperature temper treatment was performed. The low temperature temper treatment was performed at a temperature of 150° C. for 3 hours. After this low temperature treatment, the composition and hardness of the layers around the uneven dulled section changes was shown in FIG. 63. By temper rolling, ϵ carbide was precipitated in the martensite layer. The presence of the ϵ carbide slightly lowered the hardness but also reduced in brittleness.

Figure 64:
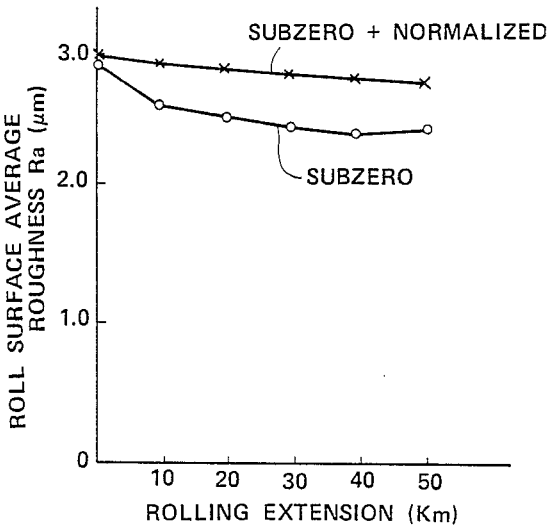
FIG. 64 is a graph showing the relationship between roughness of the roll surface and the rolling length.

The temper rolling was performed utilizing a work roll, on which low temperature temper treatment was performed for low carbon Al killed steel of 0.8 mm thickness. The temper rolling was performed in a draft of 0.8. Roughness variation in this temper rolling is shown in FIG. 64. In FIG. 64, comparative example is shown, which is obtained from temper rolling in the same condition by means of the work roll to which the temper treatment is not performed. As is clear from FIG. 64, the temper treated work roll exhibits a substantially low rate of roughness drop throughout the extensive length of temper rolling.

In addition, the preferred embodiment of the laser beam dulled work roll as set forth above, which was dulled by means of the laser beam and subjected to subzero treatment, was further subjected to plating. Namely, the preferred embodiment of the laser beam dulled work roll is, at first, subjected to subzero treatment by means of the liquid state nitrogen. The subzero treated work roll is processed for forming a surface hardening layer by way of plating. Plating is performed by chromium plating. The thickness of the chromium plating layer and condition of plating are as follows.

As a plating bath, a surgent bath ($CrO_3$: 200 g/l, $H_2SO_4$: 2 g/l) is used. Plating is performed by static plating at a temperature of the bath at 50° C., electric current intensity of 30 A/dm$^2$. thickness of the plated chromium coat layer was 10 μm.

Figure 65:
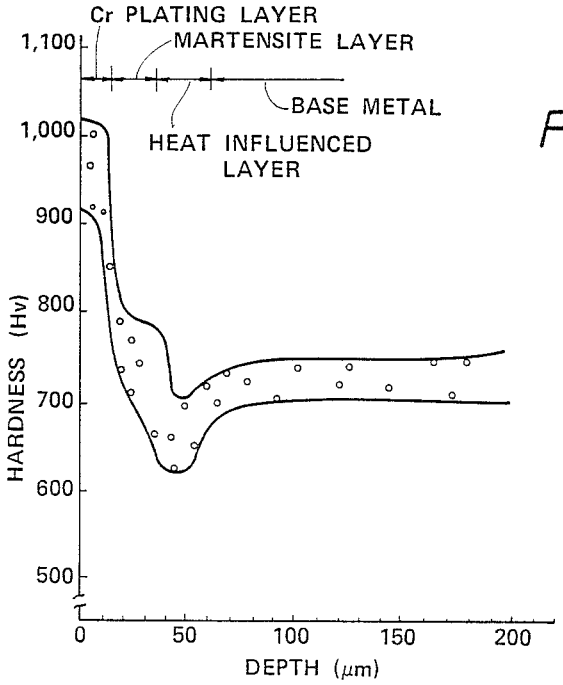
FIG. 65 shows examples of the relationship between the depth and hardness on the surface portion of the work roll.

The hardness distribution and construction of the surface portion around the uneven dulled section on the work roll after plating is shown in FIG. 65. As seen from FIG. 65, the Cr plating coat layer 2*p* was formed as a surface coat layer. Therefore, the surface portion of the uneven dulled section 1 is constituted by four surface layers 2*p*, 2*a*, 2*b* and 2*c* are formed on the base metal 2*d*. An surface layer 2*p* is a Cr plating layer of 10 μm in thickness.

Similarly to the above, the temper rolling was performed utilizing the work roll, on which low temperature temper treatment was performed for low carbon Al killed steel of 0.8 mm thickness. The temper rolling was performed in a draft of 0.8. By the presence of the Cr plating coat layer, the roughness change in temper rolling was extremely small, and substantially no roughness change could be observed for temper rolling in an extension of 50 Km.

On the other hand, roughness drop may be reduced by making the height of the annular crests formed around the concave portions of the uneven dulled sections. In order to obtain the even height of annular crests, normalization treatment is preferably performed after dulling operation by means of laser beam.

Normalization treatment can be performed by rotatingly driving the work roll in a condition kissing the back-up roll. If the pressure to depress the work roll onto the back-up roll is excessive, reduction of height of the crests becomes substantial to make the height insufficient for temper rolling of the metal sheet. Through experimentation, it has been found that the pressure criterion in normalization treatment was 60 Kg/mm$^2$. That is, when the contact pressure between the work roll and the back-up roll is greater than 60 Kg/mm$^2$, the height reduction of the crest becomes unacceptably great. Therefore, the normalization treatment by kiss-rolling has to be performed at a contact pressure lower than or equal to 60 Kg/mm$^2$.

For example, normalization treatment may be performed for a work roll having a surface roughness Ra of 0.5 μm, at a contact pressure of 40 Kg/mm$^2$. In this normalization treatment, the work roll was driven at a speed corresponding to 50 m/min of rolling, for 5 min.

Normalization treatment can also be performed by grinding. In practice, grinding may be performed by means of a grindstone or sand-paper. The grinding operation is performed by driving the work roll to rotate at a predetermined speed, e.g. lower than or equal to 50 r.p.m. Grindstone or sand-paper will be depressed onto the roll surface at a pressure lower than or equal to 10 Kg/mm$^2$.

Pratical grinding is performed by rotating the work roll at a speed corresponding to a rolling speed of 30 m/min. As a grinding tool, #600 emery paper in a strip form was used. The emery paper was depressed onto the roll surface at a pressure of about 5 Kg/mm$^2$.

Furthermore, normalization treatment can also be performed by blasting, such as shot blasting, sand blasting and so forth.

Figure 66A:
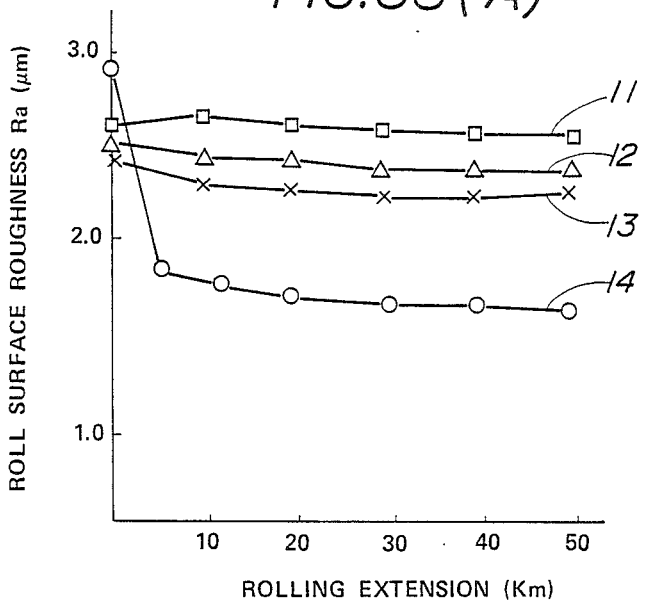
FIGS. 66(A) and 66(B) are graphs showing the relationship between roughness on the surface of the work roll and the metal sheet and the rolling length.
Figure 66B:
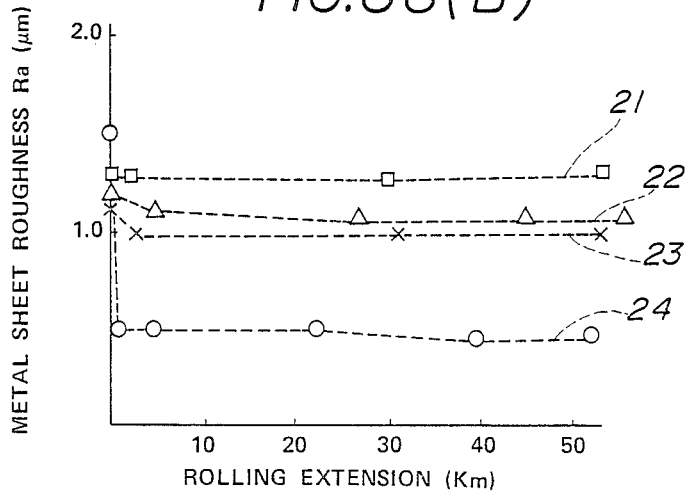

By performing a normalization treatment, the actually applied pressure to unit area of the top of crest can be reduced. As set forth, the preferred actually applied pressure to the unit area is lower than or equal to 1000 Kg/mm$^2$. Variations of roughness on the work roll which are processed in various ways and the metal sheets which are temper rolled by means of the work rolls are shown in FIGS. 66(A) and 66(B).

Figure 67:
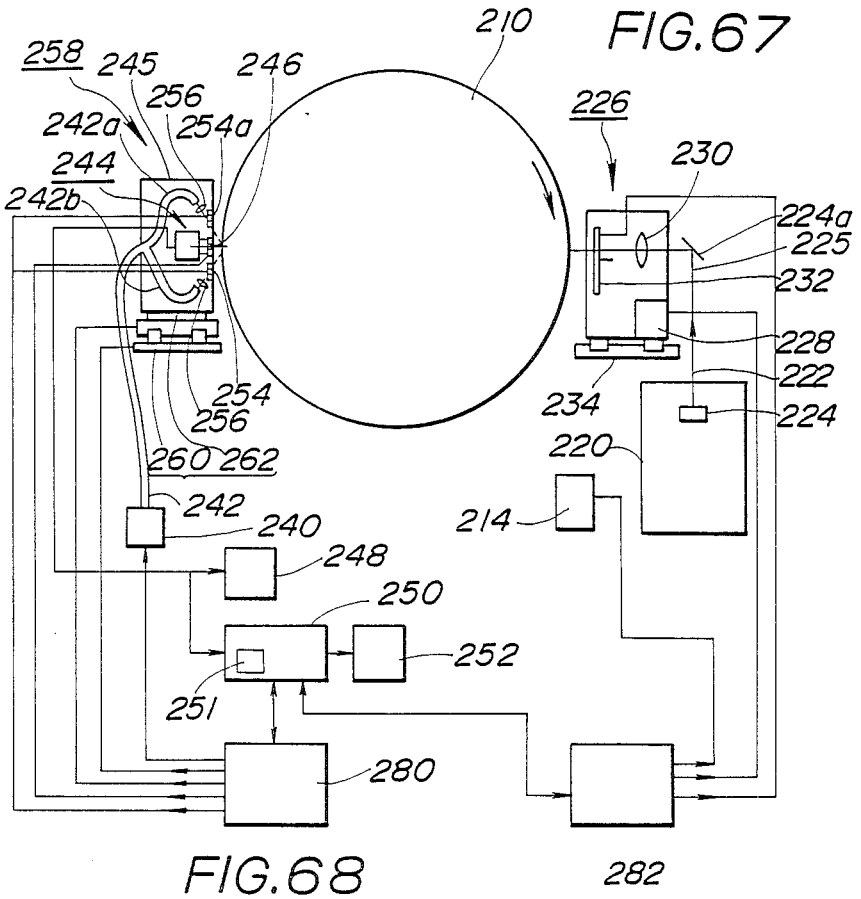
FIG. 67 is a block diagram of one embodiment of a control system for controlling a laser beam dulling operation for the work roll according to the invention.
Figure 68:
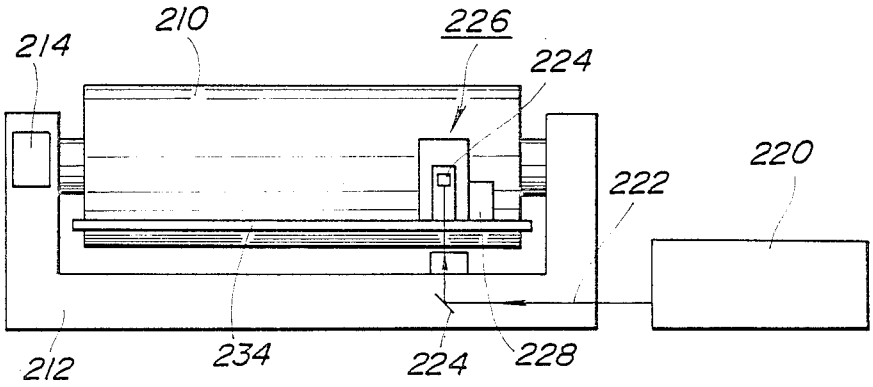
FIG. 68 is a partial front elevation of the preferred embodiment of the apparatus with the control system of FIG. 67.

FIG. 67 shows the preferred embodiment of a control system for controlling operation of the work rolling dulling apparatus of FIG. 55. As set forth, a work roll 210 to be dulled is rotatably supported on a roll support 212 as shown in FIG. 68. Though it is not clearly shown on the drawings, the roll support 212 includes a driving mechanism for rotatingly drive the roll 210. The drive mechanism is associated with a rotation speed controller 214. As set forth, a laser beam generator unit 220 is provided in the vicinity of the roll support. The laser beam generator unit 220 includes a deflector assembly 224 for deflecting the generated laser beam along a laser beam path 225. A deflector mirror 224*a* is inserted within the laser beam path 225 for deflecting the laser beam output from the laser beam generator unit 220 toward a laser head unit 226. The laser head unit 226 includes a lens assembly 30 for focusing the laser beam onto the predetermined spot on the outer periphery of the work roll 210 and a rotary chopper 232. The rotary chopper serves for generating pulsatile laser beam to be irradiated onto the roll periphery. The laser head is mounted on a laser head base 234, on which guide rails are mounted in substantially transversely to the longitudinal axis of the work roll. The laser head unit 226 is movable toward and away from the work roll surface along the guide rails by means of a drive device 228. On the other hand, the laser head base 234 is movable in a direction parallel to the longitudinal axis of the work roll. The drive mechanism is similar to that illustrated in FIG. 55. Namely, a spiral rod drivingly meshes with the laser head base for causing an axial shift of the base with the laser head unit 226 in a magnitude corresponding to the magnitude of rotation of the spiral rod.

In the practical dulling operation, since the laser beam is focused and irradiated as a substantially high density energy beam, the uneven dulled section is formed on the roll surface substantially in a moment. Namely, irradiation of the laser beam causes melting of the surface material to cause vaporization of the material at the laser beam irradiating spot to form the concave portion and the annular crest.

In order to adjust the pitch of the uneven dulled sections in circumferential and axial directions, a control system is provided. The control system includes a system for monitoring the surface condition of the work roll on which dulling operation is performed.

The roll surface monitoring means includes a lighting device which includes a light source unit 240. As a light source unit 240, a strobe light source is used. The light source unit is connected to a light path 242 which comprises an optical fiber. The light path 242 is bifurcated at the ends into two branches 242*a* and 242*b*. Both of the branches 242*a* and 242*b* cooperate with an optical detector head unit 258 and are directed to a common monitoring point M on the work roll surface. The optical detector unit 258 includes shutters 254*a* and 254*b* for establishing and blocking the light path from the ends of the branches 242*a* and 242*b* of the light path 242 to the monitoring point M. In the preferred construction, the shutters 254*a* and 254*b* are open and closed synchroneously to each other. On the other hand, the shutters 254*a* and 254*b* may be driven to open and close in an asynchroneous manner.

It should be appreciated that, though the light path in the shown embodiment is provided with bifurcated branches, it can be possible to provide three or more branches for the light path for irradiating the strobe lights onto the monitoring point M from different directions. Separation of the irradiating directions of the light beam is beneficial for detecting directionality of the uneven dulled sections formed on the work roll. Namely, the crests in the uneven dulled sections have anisotophy. The anisotrophy of the crests can be detected by picking up still images by directing the irradiation light beam from different directions. By comparing the picked up still images, the anisotrophy can be detected.

In the preferred construction, the irradiation light beams are irradiated from a common plane including normal from the roll surface. The irradiation points are selected on the aforementioned plane to be symmetric to each other with respect to the normal and to have an incident angle greater than or equal to 60°.

Figure 71:
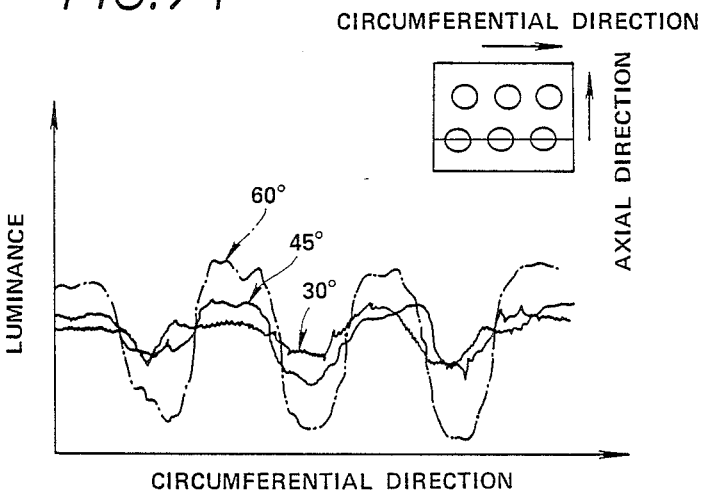
FIG. 71 is a graph showing variations of the luminance level to be detected according to variations of the incident angle of the laser beam.

In order to select the incident angle of the light beam, experimentations were performed at different angles, i.e. 30°, 45° and 60°. The resultant luminance data at respective incident angles are shown in FIG. 71. As will be seen from FIG. 71, the sensitivity of the luminance difference on the flat section and dulled section at the incident angle 60° was much higher than that of lower incident angles. Higher angle may increase the sensitivity in image processing. However, higher incident angle required greater vertical height of the system. In view of this, the incident angle at about 60° may be optimum in view of balance of the system size and the performance.

Opposing the monitoring point M, an image pick-up device 244 is provided. The image pick-up device employed in the shown embodiment is designed to pick-up an enlarged still image of the roll surface at the monitoring point. For automatically focusing the image pick-up device 244, an focusing device 246 may be combined with the image pick-up device 244. The image pick-up device 244 is connected to a display monitor unit 248 and an image data processing unit 250. The image data processing unit 250 processes the image data input from the image pick-up device 244 to derive an output signal. The output signal is then output via an output unit 252. The image data processing unit 250 is also connected to a timing control unit 280 and a laser control unit 282. The timing control unit 280 controls the irradiation timings of the light beam and image pick-up. On the other hand, the laser control unit 282 controls operation of the drive unit 228 for adjusting the irradiation point of the laser beam on the roll surface and operation of the chopper 232 for adjusting the laser beam irradiation timing and irradiation period.

On the other hand, the image pick-up device 244 is housed in a housing 245 which is mounted on a movable base. Guides 260 and 262 are provided for allowing movement of the housing 245 in transverse and axial directions. The housing 245 is associated with a drive means (not shown) to be driven toward and away from the monitoring point M along the guide 260. On the other hand, the housing 245 is driven by the driving means in axial direction along the guide 262. The axial movement of the housing 245 with the image pick-up device may be controlled in synchronism with axial movement of the laser head unit.

Figure 69:
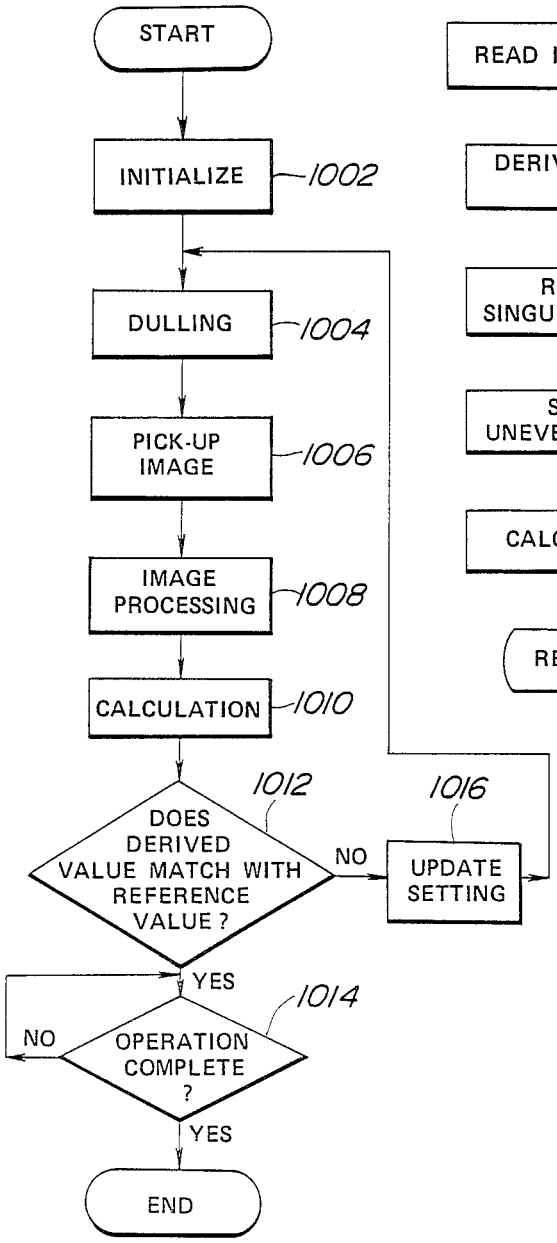
FIG. 69 is a flowchart showing the laser beam dulling control program to control the dulling system of FIG. 67.

The control operation to be performed in the aforementioned control system will be described herebelow with reference to the flowcharts in FIGS. 69 and 70. FIG. 69 shows a main control program to be executed for controlling operation of the laser beam dulling operation based on image data picked-up by the image pick-up device.

Immediately after starting execution of the control program, the overall system is initialized at a step 1002. In this step, laser beam intensity, rotation speed of the work roll, rotation speed of the chopper, axially shifting pitch and other dulling conditions are initially set. This initial set of the system is done according to the control signals output from the laser control unit 282. Namely, in the initial set, the laser control unit 282 outputs control signal indicative of the initially set distance between the laser head unit 226, axially shifting pitch of the laser head unit 226 and the laser beam irradiation point on the work roll, for controlling the drive device 228 to move the laser head unit 226 for adjusting the distance to the irradiation point on the outer periphery of the work roll. The rotation speeds of the work roll and the chopper may be set at predetermined initial values. At a step 1004, laser beam dulling operation is performed in the initially set condition. In order to perform the laser beam dulling operation, the laser control unit 282 outputs control signal to the chopper drive device (not shown) to rotatingly drive the chopper at the initially set rotation speed. At the same time, the laser control, unit 282 outputs control signal for the drive mechanism for the work roll to rotatingly drive the work roll at the initially set speed. At this time, the control signal indicative of performance of the dulling operation from the laser control unit 282 is fed to the image processing unit 250. The image processing system 250 is responsive to the input from the laser control signal to output control signals to the timing control unit 280. The timing control unit 280 is responsive to the input from the image processing unit 250 to output control signals to the image pick-up device 244, the strobe light source unit 240, the shutters 254*a* and 254*b* for synchroneously operating those components, at a step 1006. As a result, a still image of the surface of the work roll is picked up at the step 1006. The image data picked-up in the step 1006 is input to the image processing unit 250 and stored in a field memory 251 in the unit. The image data is then processed in known manner of image processing, at a step 1008. Based on the processed image data, the property of the surface components, i.e. configuration of the uneven dulled section, size thereof, the pitch of the uneven sections, and so forth are calculated, at a step 1010. Such calculated data are in a form of numerical data to be compared with a predetermined value, at a step 1012.

When the numerical data obtained from calculation matches the predetermined value or within a predetermined acceptable range relative to the predetermined value, the dulling operation is performed for the whole surface of the work roll with the condition set in the step 1002. Thereafter, the process goes to a step 1014. At a step 1014, check is performed whether dulling operation is completed or not. The check at the step 1014 is repeated until the whole surface of the work roll is dulled.

On the other hand, if the numerical data does not match with the predetermined value or outside of the acceptable range relative to the predetermined value, set values at the step 1002 are updated at a predetermined rate or values at a step 1016. The process then returns to the step 1004 to perform dulling operation at the step 1004, image pick-up operation at the step 1006, image processing operation at the step 1008, calculation of the numerical data at the step 1010 and comparing operation of the numerical data with the predetermined value at the step 1012. Therefore, the steps 1004, 1006, 1008, 1010, 1012 and 1016 loops until the dulling condition which can obtain the numerical value matching with or within the given acceptable range of the predetermined value is obtained. In this case, when the numerical data machining with the predetermined value or within the acceptable range with respect to the predetermined value is obtained, the dulling condition is fixed at the condition set at the step 1016 in the preceding cycle of loop.

Figure 70:
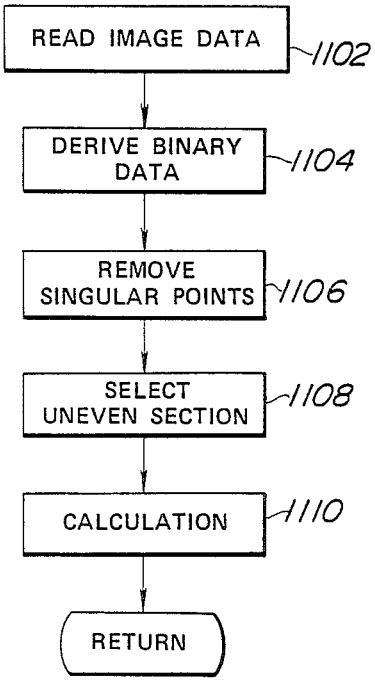
FIG. 70 is a flowchart showing a process of image processing to be performed in the control system of FIG. 67.
Figure 72:
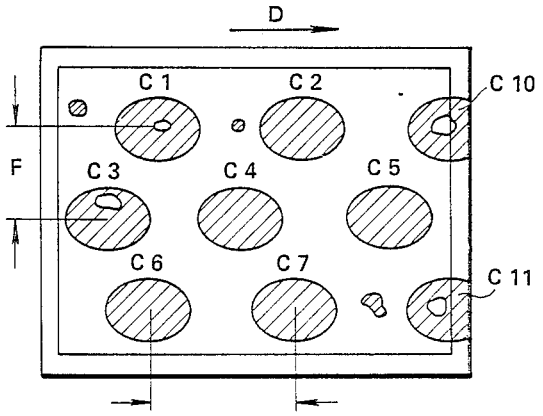
FIG. 72 is an enlarged and explanatory illustration of the image of the roll surface.

FIG. 70 shows a sub-routine to be executed in the image processing step of the step 1008. In a step 1102, the picked-up enlarged still image data is read out from the field memory 251. Each pixel data of the image data is compared with a threshold value for obtaining binary image data, at a step 1104. The image represented by the binary image data obtained at the step 1104 is shown in FIG. 72. After the step 1104, singular point data contained in the binary image data is removed at a step 1106. Removal of the singular point data can be performed by thicken the image by lowering the threshold or ignoring dark area smaller than a predetermined area. After the step 1106, image data of the uneven dulled section at the outer frame of image data is removed at a step 1108 and whereby the image data to be analyzed is selected. In the example of FIG. 72, the image data of the uneven dulled sections of $C_{10}$ and $C_{11}$ on the frame were removed. Thereafter, the configuration of each remained uneven dulled sections $C_1$through $C_7$, the distances p in axial direction D and F in circumferential direction are calculated at a step 1110. After the step 1110, the process returns to the main program.

By performing the foregoing control operation, the dulling condition can be adjusted to obtain predetermined size and configuration of the uneven dulled sections with predetermined distances in axial and circumferential directions.

Figure 73:
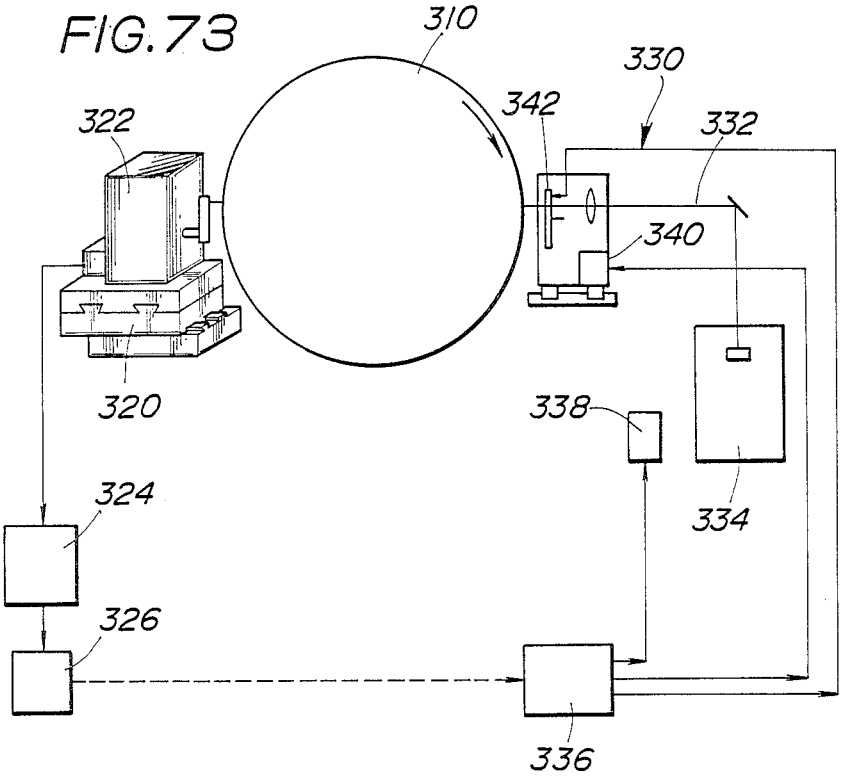
FIG. 73 is a block diagram of another embodiment of a laser beam dulling control system according to the invention.

Another embodiment of the dulling control system according to the present invention is illustrated in FIG. 73. This embodiment employs a contact needle type roughness gauge unit 322. The roughness gauge unit 322 is mounted on an X-Y stage 22 which allows shifting of the roughness gauge on an X-Y coordinate system established therein.

The roughness gauge 322 is designed to keep the needle in contact with the roll surface to cause displacement of the needle along the uneveness on the roll surface. The roughness gauge monitors the stroke of the needle and thereby detects the uneveness on the roll surface to produce a roughness indicative signal variable of the surface position relative to the guage. The roughness indicative signal is fed to a processing unit 324 which processes the input signal to make judgement whether the roughness condition on the work roll surface matches with the predetermined condition. Based on this, the processing unit 324 generates a control signal to be output to a laser control unit 336 via an output unit 326. The laser control unit 336 derives control signals based on the input signal from the processing unit. The control signals are output from the laser control unit to a work roll rotation controller 338, a drive mechanism 340 for driving the work roll transversely to the roll axis and a chopper 342 in a lease beam head 330 which irradiates a laser beam generated by a laser beam generator unit 334 and transmitted via a laser beam path 332.

Figure 74:
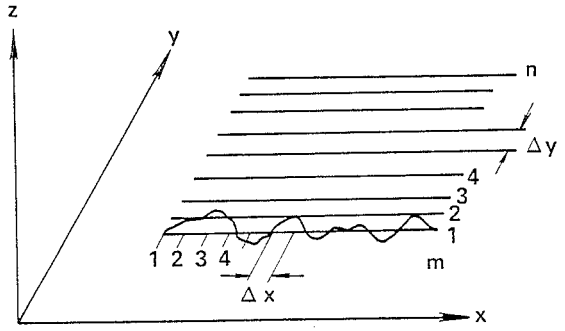
FIG. 74 is an illustration showing positions of roughness gauges to be employed in the control system of FIG. 73.

In the practical control operation, the detection of the roll surface roughness is performed regarding the roll surface as a two-dimensional plane. Scanning of the roll surface by means of the needle is performed in a pattern as shown in FIG. 74. As seen from FIG. 74, the scanning is performed in the x-axis direction which direction corresponds to the axial direction of the work roll. Each scanning line is substantially parallel to the longitudinal axis of the work roll. The pitch $\Delta y$ of the scanning lines in the y-axis direction set substantially smaller than that of the peripheral length of the work roll so that curvature of the roll may not substantially influence the result of roughness detection.

Assuming the sampling interval in the x-axis direction being $\Delta x$ ($\mu$m), the pitch of the scanning line in the y-axis direction is $\Delta y$ ($\mu$m) as set forth above, the number of sampling points in each scanning line being m, and the number of the scanning lines being n, the area to be scanned can be illustrated by:

$$\Delta x \times (m-1) \times \Delta y \times (n-1) \quad [\mu m^2]$$

The coordinates of each sampling point on the roll surface in a three-dimensional coordinate system established on the X-y coordinate system can be (xi, yj, zij), the following three equations can be obtained:

$$Zij = f(xi, yi) \quad (1)$$

where f is a function representing uneven profile on the roll surface $$xi = \Delta x \times (i-1) \quad (2)$$

where $i = 1, 2, \ldots (m-1)$ $$yi = \Delta y \times (j-1) \quad (3)$$

where $j = 1, 2, \ldots n$

Here, the inclination $\Delta zij$ at each sampling point may be defined by:

$$\begin{aligned} \Delta zij &= \{\partial \cdot f \cdot (xi, yj\}/\partial \cdot xi \\ &= \{f \cdot (xi+1, yj) - f \cdot (xi, yi)\}/\{(xi+1) - xi\} \\ &= (i+1, j-1)/\Delta x \end{aligned} \quad (4)$$

where $i = 1, 2, \ldots (m-1)$
$j = 1, 2, \ldots (n-1)$

As will be appreciated herefrom, the $\Delta zij$ represents unit height difference between adjacent sampling points. Therefore, in the monitoring area, $(m-1) \times (n-1)$ of $\Delta zij$ can be obtained. Then, $(m-1) \times (n-1)$ of $\Delta zij$ is divided into a given number of regions, e.g. $2\beta$. Distance between the regions is set at $\alpha$. From this the following formula can be established:

$$\alpha \times \{-\beta + (k-1)\} \leqq Zij < \alpha \times (-\beta + k) \quad (5)$$

where $k = 1, 2, \ldots 2\beta$

Assuming $\alpha \times \{-\beta + (k-1)\}$ is equivalent to $\gamma$, the foregoing formula (5) can be modified as:

$$\gamma(k) \leqq zij < \gamma(k+1) \quad (6)$$

Here, each region defined by the foregoing equation (6) is set as "A(k)" and number of inclination indicative values $\Delta zij$ in each region A(k) relative to the total number $\{(m-1) \times (n-1)\}$ is set as $T_0$ (k). In addition, the average value of $T_0$ with the adjacent region is set as "T(k)". This T can be illustrated by:

$$T(k) = \tfrac{1}{2} \times \{T_0(k) + T_0(k-1)\} \quad (7)$$

where $k = 1, 2 \ldots (2\beta - 1)$

Figure 75:
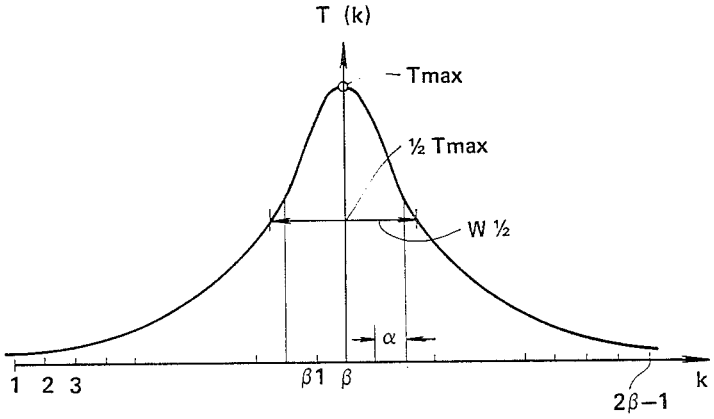
FIG. 75 is an illustration showing the manner of analysis of inclination distribution.
Figure 76:
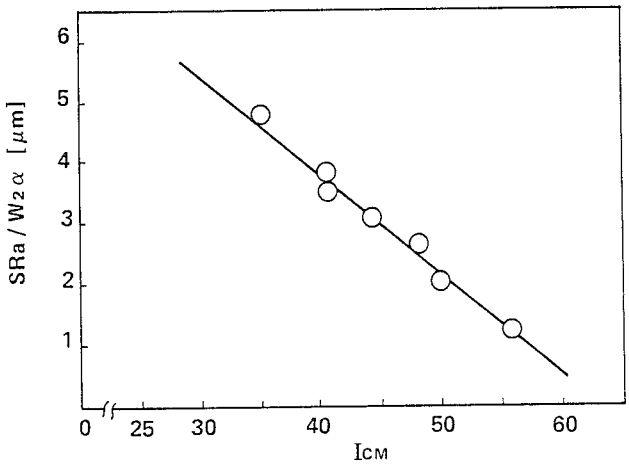
FIG. 76 is a graph showing the relationship between glossiness and $SRa/W_2a$.

By taking this k as horizontal axis, a graph of variation of T can be illustrated as shown in FIG. 75. This graph shows inclination $\{\alpha \times (-\beta + k)\}$. Here, the T value at k $(=\beta)$ is $T_{max}$. The sum value of T values in a range $(\beta - 2) \leqq k \leqq \beta + 2)$ is $\Delta W\alpha$. $T_{max}$ indicates a ratio of the roughness condition on the surface where $\Delta zij$ becomes zero. On the other hand, $\Delta W\alpha$ represents ratio of the roughness condition where $|\Delta zij| \leqq 2\alpha$. These values represents area ratio of the flat area on the dulled roll surface.

In order to know the relationship between the aforementioned values $T_{max}$ and $\Delta W\alpha$ to the image clarity on the painted surface of the metal sheet temper rolled by means of the dulled work roll, experimentation was performed. In the experimentation, bright rolls (sample A), shot blasted rolls (sample B) and laser dulled rolls (sample C) are used. Each ten of samples A, B and C are monitored by means of the roughness gauge set forth above in a conditions:

$m = 500$
$n = 160$
$\alpha = 0.03$
$\beta = 20$

Results of measurement are shown in the appended Table 2. In the Table 2, the SRa is a value representative of the height of the annular crest formed around the concave of the uneven dulled section on the work roll surface. From the experimentation, it was confirmed that greater values of $T_{max}$ and $\Delta W\alpha$ exhibit higher image clarity.

Figure 77:
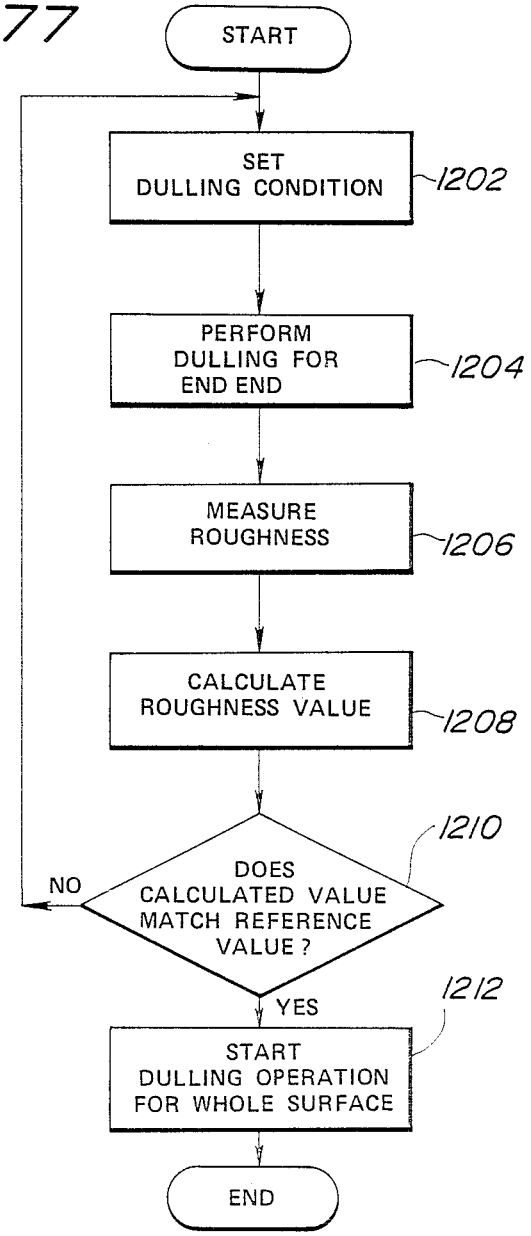
FIG. 77 is a flowchart showing a laser beam dulling control program to be executed in the control system of FIG. 73.

FIG. 77 shows a flowchart showing operation to be performed by the dulling control system of FIG. 73. In practical execution of the program, the roll dulling condition is set immediately after starting execution, at a step 1202. According to the dulling condition set in the step 1202, dulling operation is performed only at one end of the work roll, at a step 1204. After completing dulling operation for a given area. Dulling operation is temporarily stopped at a step 1206. In this condition, roughness measurement is performed in a process set forth above, at the step 1206.

At a step 1208, arithmetic operation for deriving the aforementioned values, e.g. $T_{max}$, $\Delta W\alpha$ and so forth, is performed based on the roughness indicative signal values as obtained at the step 1206. The obtained values are compared with respectively corresponding reference values which represents desired roughness condition, at a step 1210. If the derived values matches with or within given acceptable ranges with respect to the reference values as checked at the step 1210, continuous dulling operation is started at a step 1212. In this case, the dulling operation is performed in the dulling condition set at the step 1202.

On the other hand, if the derived values do not match or out of the acceptable range relative to the reference values, the process returns to the step 1202 to change the dulling condition according to a given schedule. The steps 1202, 1204, 1206, 1208 and 1210 are repeated until the dulling condition, on which the $T_{max}$, $\Delta W\alpha$ and so forth matching with or within the acceptable range of the reference values can be obtained.

Therefore, this embodiment of FIG. 73 provides desired surface condition of the work roll dulled by the laser beam.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the shown embodiments which can be embodied without departing from the principle of the invention set out in the appended claims.

TABLE 1

| | SAMPLE A | SAMPLE B | SAMPLE C |
|---|---|---|---|
| SURFACE ROUGHNESS CONDITION | | | |
| AVE. D (μm) | 122.5 | 110.0 | 254.0 |
| AVE. Sm (μm) | 186.3 | 121.0 | 444.5 |
| Sm/D | 1.52 | 1.10 | 1.75 |
| η(%) | 78.7 | 57.9 | 86.1 |
| $(SM\text{-}D)_1$ (μm) | 64.0 | 11.0 | 190.0 |
| $(SM\text{-}D)_2$ (μm) | 131 | 61 | 375 |
| RESULT OF PRESS TEST | SLIGHTLY BAKED | NOT BAKED | BAKED |

TABLE 2

| ROLL | Tmax (%) | $W_{2\alpha}$(%) | SRa (μm) |
|---|---|---|---|
| BRIGHT | 35~50 | 75~95 | 0.2~0.25 |
| SB | 10~20 | 25~45 | 1.1~3.0 |
| LD | 20~30 | 45~65 | 0.9~3.2 |

What is claimed is:

1. A work roll for temper rolling a metal sheet comprising;

a peripheral surface formed with a plurality of uneven sections in a spaced apart relationship to each other, each uneven section being constituted of a depression and an annular ring shaped projection surrounding said depression, said uneven sections being arranged to have a ratio between a center-to-center distance between adjacent uneven sections and the external dimension of the uneven section in a range of 0.85 to 1.7, and a difference between the center-to-center distance and the external size smaller than 280 μm.

2. A work roll as set forth in claim 1, wherein at least said projection has a hardened surface layer.

3. A work roll as set forth in claim 1, wherein the surface portion of said work roll at said uneven section is constituted with a plurality of different composition layers, which includes a first outermost layer of martensite, a second layer next to said first layer containing martensite and ε (epsilon) carbide, and a third layer containing martensite and carbide.

4. A work roll as set forth in claim 3, wherein said first layer is in a thickness range of 5 to 30 μm, said second layer is in a thickness range of 5 to 30 μm, and said third layer is in a thickness range of 5 to 30 μm.

5. A work roll as set forth in claim 4, wherein said first layer also contains austenite.

6. A work roll as set forth in claim 5, wherein said surface portion at said uneven section has a surface coat layer over said first layer.

7. A work roll as set forth in claim 6, wherein said surface coat layer is formed by plating.

8. A work roll as set forth in claim 7, wherein said plated surface coat layer is composed of chromium.

9. A work roll as set forth in claim 1, wherein said work roll has a contact area constructed to actually contact a back-up roll during a temper rolling operation, on which contact area, a pressure lower than 1000 $Kgf/mm^2$ is exerted.

10. A work roll as set forth in claim 9, wherein at least said projection has a hardened surface layer.

11. A work roll as set forth in claim 9, wherein a surface portion of said work roll comprises a plurality of different composition layers, which includes a first outermost layer comprising a composition of martensite, a second layer next to said first layer containing martensite and ε (epsilon) carbide, and a third layer containing martensite and carbide.

12. A work roll as set forth in claim 11, wherein said first layer is in a thickness range of 5 to 30 μm, said second layer is in a thickness range of 5 to 30 μm, and said third layer is in a thickness range of 5 to 30 μm.

13. A work roll as set forth in claim 12, wherein said first layer also contains a composition of austenite.

14. A work roll as set forth in claim 13, wherein said surface portion at said uneven section has a surface coat layer over said first layer.

15. A work roll as set forth in claim 14, wherein said surface coat layer is formed by plating.

16. A work roll as set forth in claim 15, wherein said plated surface coat layer is composed of chromium.

* * * * *

UNITED STATES PATENT AND TRADEMARK OFFICE

CERTIFICATE OF CORRECTION

PATENT NO. : 4,841,611

DATED : June 27, 1989

INVENTOR(S) : Takashi Kusaba; Hideo Abe; Akira Torao; Kussuo Furukawa; Takayuki Yanagimoto; Hiroaki Sasaki It is certified that error appears in the above-identified patent and that said Letters Patent is hereby corrected as shown below:

Column 3, line 49, change " 30 82 m" to --30 um--.

Column 37, Table 1, change "SURFACE ROUGHNESS CONDITION AVE.D (um) AVE.Sm (um) Sm/D n(%)"

to -- SURFACE ROUGHNESS CONDITION AVE.D (um) AVE.Sm (um) Sm/D n(%) --

Signed and Sealed this

Sixteenth Day of July, 1991

*Attest:*

*Attesting Officer*

HARRY F. MANBECK, JR.

*Commissioner of Patents and Trademarks*